US011332332B2

(12) United States Patent
Shimosaka et al.

(10) Patent No.: US 11,332,332 B2
(45) Date of Patent: May 17, 2022

(54) MEDIUM CONVEYING APPARATUS FOR DETECTING A FOLDING OF A MEDIUM

(71) Applicant: PFU LIMITED, Kahoku (JP)

(72) Inventors: Kiichiro Shimosaka, Kahoku (JP); Masato Shimura, Kahoku (JP)

(73) Assignee: PFU LIMITED, Kahoku (JP)

( * ) Notice: Subject to any disclaimer, the term of this patent is extended or adjusted under 35 U.S.C. 154(b) by 268 days.

(21) Appl. No.: 16/667,569

(22) Filed: Oct. 29, 2019

(65) Prior Publication Data

US 2020/0198908 A1 Jun. 25, 2020

(30) Foreign Application Priority Data

Dec. 20, 2018 (JP) ..... JP2018-238434

(51) Int. Cl.
*B65H 3/06* (2006.01)
*B65H 7/14* (2006.01)

(52) U.S. Cl.
CPC ..... *B65H 3/0661* (2013.01); *B65H 7/14* (2013.01); *B65H 2301/44324* (2013.01); *B65H 2511/522* (2013.01); *B65H 2553/414* (2013.01); *B65H 2553/46* (2013.01)

(58) Field of Classification Search
CPC .. B65H 3/0661; B65H 7/14; B65H 2511/522; B65H 2301/44324
See application file for complete search history.

(56) References Cited

U.S. PATENT DOCUMENTS

| | | | | |
|---|---|---|---|---|
| 9,039,010 | B2 * | 5/2015 | Umi | B65H 3/0653 271/265.01 |
| 10,124,969 | B2 * | 11/2018 | Yoshiwara | B65H 3/06 |
| 10,584,007 | B2 * | 3/2020 | Matsumura | B65H 1/04 |
| 2018/0215564 | A1 | 8/2018 | Matsumura | |
| 2021/0188581 | A1 * | 6/2021 | Niwata | B65H 7/06 |
| 2021/0253387 | A1 * | 8/2021 | Funaki | B65H 3/06 |

FOREIGN PATENT DOCUMENTS

| | | | |
|---|---|---|---|
| JP | 5-58512 | A | 3/1993 |
| JP | 2005-104683 | A | 4/2005 |
| JP | 2017-147603 | A | 8/2017 |
| JP | 2018-122950 | A | 8/2018 |

* cited by examiner

*Primary Examiner* — Patrick Cicchino
(74) *Attorney, Agent, or Firm* — Lewis Roca Rothgerber Christie LLP

(57) ABSTRACT

A medium conveying apparatus includes a first optical sensor located on an upper part of the housing and in a central part of the housing in a direction perpendicular to a medium conveying direction, a second optical sensor located on an upper part of the housing and on a side of the first optical sensor in the direction perpendicular to the medium conveying direction, and a processor to detect a folding of a medium based on the first signal or the second signal, and stop feeding of the medium by the feed roller in accordance with a detection result of the folding of the medium. The first light emitter emits first light toward a downstream side of the medium in the medium conveying direction, and the second light emitter emits second light toward an upstream side of the medium in the medium conveying direction.

20 Claims, 18 Drawing Sheets

MEDIUM CONVEYING APPARATUS FOR DETECTING A FOLDING OF A MEDIUM

CROSS-REFERENCE TO RELATED APPLICATIONS

This application is based upon and claims the benefit of priority of prior Japanese Patent Application No. 2018-238434, filed on Dec. 20, 2018, the entire contents of which are incorporated herein by reference.

TECHNICAL FIELD

Embodiments discussed in the present specification relate to medium conveyance.

BACKGROUND

A medium conveying apparatus, such as a scanner, for conveying a medium, such as a document, and reading an image of the conveyed medium has a function of separating and feeding a plurality of media. However, when a medium folded in two, a bound medium, such as a transportation slip or a passport, etc., is conveyed in a state in which the function of separating and feeding a plurality of media is enabled, the medium may not be separated, and a medium jam may occur.

A sheet feeding device including height detection sensors being located at positions different from one another with respect to a width direction perpendicular to a sheet feeding direction, each height detection sensor detecting a position of a highest sheet loaded on a loading surface in a height direction at each position in the width direction, is disclosed (see Japanese Unexamined Patent Publication (Kokai) No. 2018-122950). The sheet feeding device stops feeding of a document based on a detection result of the height detection sensors during feeding of the document.

SUMMARY

According to some embodiments, a medium conveying apparatus includes a housing, a medium tray, a feed roller to feed a medium on the medium tray, a first optical sensor located on an upper part of the housing and in a central part of the housing in a direction perpendicular to a medium conveying direction, and including a first light emitter for emitting first light and a first light receiver for generating a first signal based on receiving the first light, a second optical sensor located on an upper part of the housing and on a side of the first optical sensor in the direction perpendicular to the medium conveying direction, and including a second light emitter for emitting second light and a second light receiver for generating a second signal based on receiving the second light, a processor for detecting a folding of the medium based on at least the first signal or the second signal, and stopping feeding of the medium by the feed roller in accordance with a detection result of the folding of the medium. The first light emitter emits the first light toward a downstream side of the medium in the medium conveying direction, the medium being placed on the medium tray, and the second light emitter emits the second light toward an upstream side of the medium in the medium conveying direction, the medium being placed on the medium tray.

According to some embodiments, a method for detecting a folding of a medium includes feeding the medium on a medium tray by a feed roller, emitting first light by a first light emitter of a first optical sensor located on an upper part of a housing and in a central part of the housing in a direction perpendicular to a medium conveying direction, generating a first signal based on receiving the first light by a first light receiver of the first optical sensor, emitting second light by a second light emitter of a second optical sensor located on an upper part of the housing and on a side of the first optical sensor on the housing in the direction perpendicular to the medium conveying direction, generating a second signal based on receiving the second light by a second light receiver of the second optical sensor, detecting the folding of the medium based on at least the first signal or the second signal, and stopping feeding of the medium by the feed roller in accordance with a detection result of the folding of the medium. The first light emitter emits the first light toward a downstream side of the medium in the medium conveying direction, and the second light emitter emits the second light toward an upstream side of the medium in the medium conveying direction.

According to some embodiments, a computer program causes a medium conveying apparatus including a housing, a medium tray, a feed roller to feed a medium on the medium tray, a first optical sensor located on an upper part of the housing and in a central part of the housing in a direction perpendicular to a medium conveying direction, and including a first light emitter for emitting first light and a first light receiver for generating a first signal based on receiving the first light, a second optical sensor located on an upper part of the housing and on a side of the first optical sensor in the direction perpendicular to the medium conveying direction, and including a second light emitter for emitting second light and a second light receiver for generating a second signal based on receiving the second light, to execute a process including detecting a folding of the medium based on at least the first signal or the second signal, and stopping feeding of the medium by the feed roller in accordance with a detection result of the folding of the medium. The first light emitter emits the first light toward a downstream side of the medium in the medium conveying direction, and the second light emitter emits the second light toward an upstream side of the medium in the medium conveying direction.

DESCRIPTION OF EMBODIMENTS

It is to be understood that both the foregoing general description and the following detailed description are exemplary and explanatory, and are not restrictive of the invention, as claimed.

Hereinafter, a medium conveying apparatus, a method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
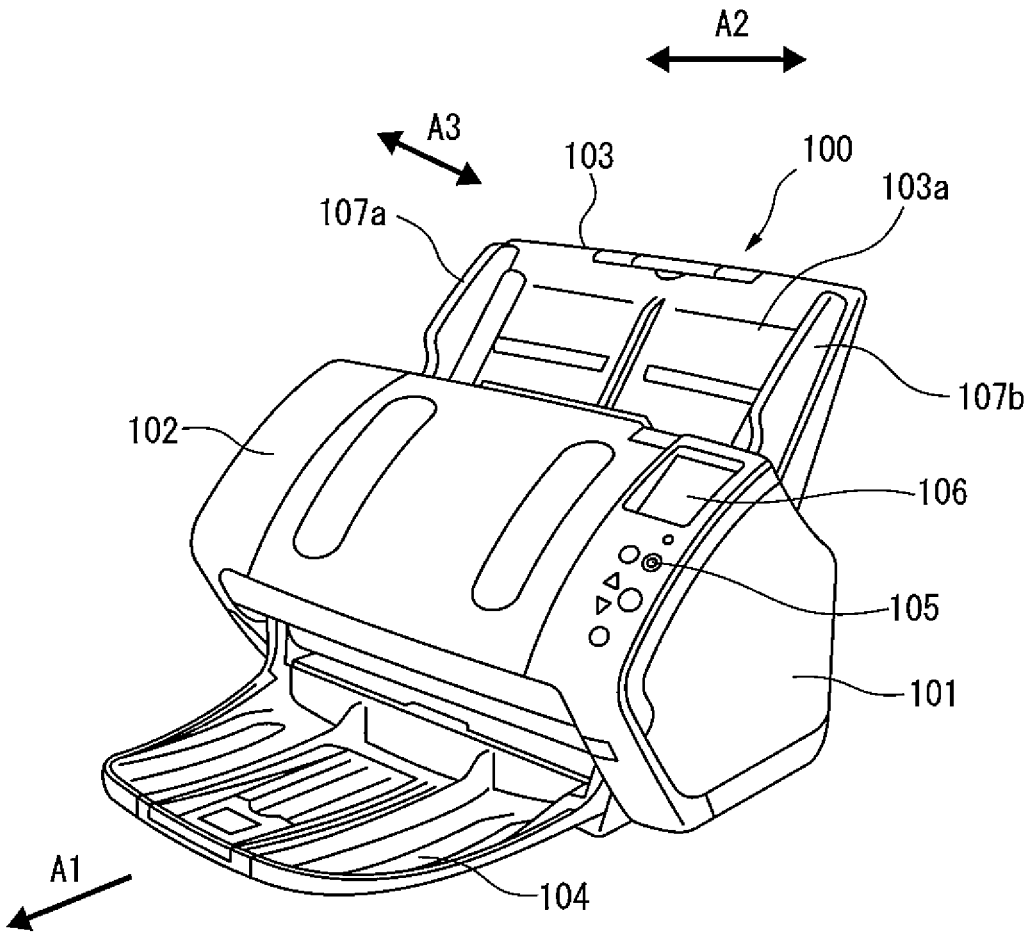
FIG. 1 is a perspective view illustrating a medium conveying apparatus 100 according to an embodiment.

FIG. 1 is a perspective view illustrating a medium conveying apparatus 100 configured as an image scanner. The medium conveying apparatus 100 conveys and images a medium being a document. Conveyed media include a brochure or a passport bound by a seam part, paper bound by a staple, paper in two by a crease part, and any other document. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, an ejection tray 104, an operation device 105, and a display device 106.

The upper housing 102 is an example of an upper part of a housing, is located in a position covering a top surface of the medium conveying apparatus 100, and is engaged with the lower housing 101 by a hinge in such a way as to be able to open and close in a case of a medium being stuck, cleaning inside the medium conveying apparatus 100, etc. Specifically, the upper housing 102 is located above the lower housing 101 and functions as a housing cover for covering the lower housing 101.

The medium tray 103 is engaged with the lower housing 101 in such a way as to be able to place a medium to be conveyed. The medium tray 103 is provided in such a way that a placement surface 103*a* of a medium is tilted against an installation surface of the medium conveying apparatus 100. The medium tray 103 includes side guides 107*a* and *b*. Each of the side guides 107*a* and *b* is provided on the medium tray 103 in such a way as to be movable in a direction A2 perpendicular to a medium conveying direction A1 and also regulates a width direction of a medium placed on the medium tray 103. Each of the side guides 107*a* and *b* is provided in such a way that a maximum height of each of the side guides 107*a* and *b* in a direction A3 perpendicular to the placement surface 103*a* is greater than a maximum media loading capacity on the medium tray 103 supported by the medium conveying apparatus 100. The side guides 107*a* and 107*b* may be hereinafter collectively referred to as side guides 107*a*.

The ejection tray 104 is engaged with the lower housing 101 in such a way as to be able to hold an ejected medium.

The operation device 105 includes an input device such as a button, and an interface circuit acquiring a signal from the input device, receives an input operation by a user, and outputs an operation signal based on the input operation by the user. The display device 106 includes a display including a liquid crystal or organic electro-luminescence (EL), and an interface circuit for outputting image data to the display, and displays the image data on the display.

Figure 2:
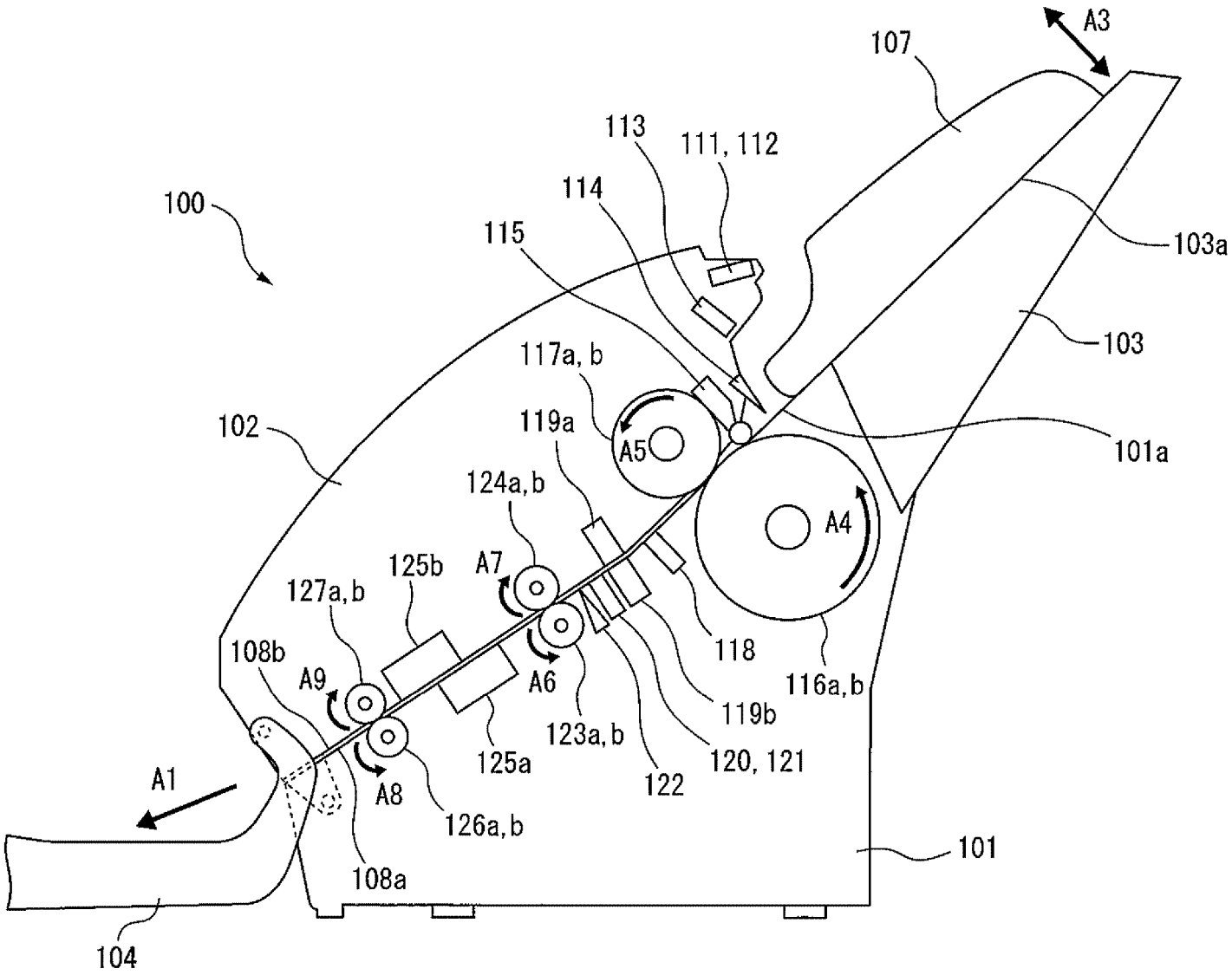
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes second optical sensors 111 and 112, a first optical sensor 113, a first medium detection sensor 114, a pick arm 115, feed rollers 116*a* and *b*, brake rollers 117*a* and *b*, a second medium detection sensor 118, an ultrasonic transmitter 119*a*, an ultrasonic receiver 119*b*, a first center sensor 115, a third medium detection sensor 120, a fourth medium detection sensor 121, a fifth medium detection sensor 122, first conveyance rollers 123*a* and *b*, second conveyance rollers 124*a* and *b*, a second center sensor 120, a first imaging device 125*a*, a second imaging device 125*b*, third conveyance rollers 126*a* and *b*, and fourth conveyance rollers 127*a* and *b*, etc.

The feed rollers 116*a* and 116*b* may be hereinafter collectively referred to as feed rollers 116. Further, the brake rollers 117*a* and 117*b* may be collectively referred to as brake rollers 117. Further, the first conveyance rollers 123*a* and 123*b* may be collectively referred to as first conveyance rollers 123. Further, the second conveyance rollers 124*a* and 124*b* may be collectively referred to as second conveyance rollers 124. Further, the first imaging device 125*a* and the second imaging device 125*b* may be collectively referred to as imaging devices 125. Further, the third conveyance rollers 126*a* and 126*b* may be collectively referred to as third conveyance rollers 126. Further, the fourth conveyance rollers 127*a* and 127*b* may be collectively referred to as fourth conveyance rollers 127.

A top surface of the lower housing 101 forms a lower guide 108*a* of a medium conveyance path and functions as a medium conveyance surface 101*a*. On the other hand, a bottom surface of the upper housing 102 forms an upper guide 108*b* of the medium conveyance path. An arrow A1 in FIG. 2 indicates a medium conveying direction. An upstream hereinafter refers to an upstream in the medium conveying direction A1, and a downstream refers to a downstream in the medium conveying direction A1.

The first medium detection sensor 114 is located on the downstream side of the second optical sensors 111 and 112, and the first optical sensor 113 in the medium conveying direction A1. The first medium detection sensor 114 includes a contact detection sensor and detects whether or not a medium exists at a position of the contact detection sensor. The first medium detection sensor 114 generates and outputs a first medium detection signal changing the signal value between a state in which a medium exists at the position and a state in which a medium does not exist at the position.

The pick arm 115 is provided on the upper housing 102 and is located on the downstream side of the first medium detection sensor 114 in the medium conveying direction A1. The pick arm 115 is an example of a pressing member and presses a medium placed on the medium tray 103. The pick arm 115 is provided at a position facing the feed rollers 116 with the medium conveyance path in between and when a medium is not fed, separates from the feed rollers 116. On the other hand, when a medium is fed, the pick arm 115 comes into contact with a medium placed on the medium tray 103 and presses the medium from above. Consequently, a moderate frictional force is generated between the feed rollers 116 and the medium, and the feed rollers 116 can satisfactorily feed the medium.

The feed rollers 116 are provided on the lower housing 101, and the brake rollers 117 are provided on the upper housing 102 to face the feed rollers 116. The feed rollers 116 and the brake rollers 117 are provided in such a way that a nip position is located on the downstream side of the pick arm 115 in the medium conveying direction A1. The feed rollers 116 and the brake rollers 117 are examples of a feeding part for separating and feeding media placed on the medium tray 103 and sequentially feed media placed on the medium tray 103 from the lowermost side. The feed rollers 116 are provided to be rotatable in a direction of an arrow A4 in FIG. 2 according to a driving force transmitted from a driving device, to be described later, and feed a medium placed on the medium tray 103 toward the medium conveying direction A1. On the other hand, the brake rollers 117 are provided to be rotatable in a direction of an arrow A5 in FIG. 2 according to a driving force transmitted from the driving device, and by rotating in the direction of the arrow A5, prevents feeding of a medium not in contact with the feed rollers 116 out of the media placed on the medium tray.

The feed rollers 116 are provided to be rotatable in a direction opposite to the direction of the arrow A4 in FIG. 2 in order to be able to reset a fed medium to the medium tray 103.

Further, in order to be able to turn the separation function OFF, the brake rollers 117 are provided in such a way as to be able to interrupt a driving force from the driving device. For example, a driving force transmission mechanism, such as a gear group, for transmitting a driving force from the driving device to the brake rollers 117 is provided between the driving device and the brake rollers 117. At least one gear in the gear group in the driving force transmission mechanism is provided to be movable, and the medium conveying apparatus 100 interrupts a driving force from the driving device to the brake rollers 117 by separating the gear from a gear engaged with the gear.

Alternatively, in order to be able to turn the separation function OFF, the brake rollers 117 may be provided in such a way as to be able to reduce a separating force by the brake rollers 117. For example, two driving force transmission mechanisms, such as gear groups, each of which transmitting a driving force from the driving device to the brake rollers 117 are provided between the driving device and the brake rollers 117. The driving force transmission mechanisms are provided with torque limiters having different torque limit values, respectively. Further, at least one gear in the gear group in the driving force transmission mechanism is provided to be movable. The medium conveying apparatus 100 reduces a separating force by the brake rollers 117 by moving the gear in each driving force transmission mechanism and, switching the driving force transmission mechanism transmitting a driving force from the driving device to the brake rollers 117.

The second medium detection sensor 118 is located on the downstream side of the feed rollers 116 and the brake rollers 117 in the medium conveying direction A1. The second medium detection sensor 118 includes a contact detection sensor and detects whether or not a medium exists at a position of contact detection sensor. The second medium detection sensor 118 generates and outputs a second medium detection signal changing the signal value between a state in which a medium exists at the position and a state in which a medium does not exist at the position. The second medium detection sensor 118 is an example of a medium detection sensor located on the downstream side of a feeding part in the medium conveying direction.

The ultrasonic transmitter 119*a* and the ultrasonic receiver 119*b* are located on the downstream side of the second medium detection sensor 118. The ultrasonic transmitter 119*a* and the ultrasonic receiver 119*b* are located close to the conveyance path of a medium in such a way as to face one another with the conveyance path in between. The ultrasonic transmitter 119*a* outputs an ultrasonic wave. On the other hand, the ultrasonic receiver 119*b* receives an ultrasonic wave being transmitted by the ultrasonic transmitter 119*a* and passing through a medium, and generates and outputs an ultrasonic signal being an electric signal corresponding to the received ultrasonic wave. The ultrasonic transmitter 119*a* and the ultrasonic receiver 119*b* may be hereinafter collectively referred to as an ultrasonic sensor 119.

The third medium detection sensor 120 is located on the downstream side of the ultrasonic sensor 119 in the medium conveying direction A1 and detects whether or not a medium exists at the position. The third medium detection sensor 120 includes a light emitter and a light receiver that are provided on one side of the medium conveyance path and a reflection member, such as a mirror, provided at a position facing the light emitter and the light receiver with the conveyance path in between. The light emitter emits light toward the conveyance path. On the other hand, the light receiver receives light emitted by the light emitter and reflected by the reflection member, and generates and outputs a third medium detection signal being an electric signal based on intensity of the received light. When a medium exists at a position of the third medium detection sensor 120, light emitted by the light emitter is shaded by the medium, and therefore a signal value of the third medium detection signal varies between a state in which a medium exists at the position of the third medium detection sensor 120 and a state in which a medium does not exist. The light emitter and the light receiver may be provided at positions facing one another with the conveyance path in between, and the reflection member may be omitted.

The fourth medium detection sensor 121 is located at the same position as the third medium detection sensor 120 in the medium conveying direction A1. The fourth medium detection sensor 121 has a configuration similar to that of the third medium detection sensor 120, and generates and outputs a fourth medium detection signal being an electric signal based on intensity of light received by a light receiver.

The fifth medium detection sensor 122 is located on the downstream side of the third medium detection sensor 120 and the fourth medium detection sensor 121 in the medium conveying direction A1. The fifth medium detection sensor 122 includes a contact detection sensor and detects whether or not a medium exists at a position of contact detection sensor. The fifth medium detection sensor 122 generates and outputs a fifth medium detection signal changing the signal value between a state in which a medium exists at the position and a state in which a medium does not exist at the position. The fifth medium detection sensor 122 is an example of a medium detection sensor located on the downstream side of a feeding part in the medium conveying direction.

The first imaging device 125*a* includes a reduction optical system type line sensor including an imaging element based on charge coupled devices (CCDs) linearly located in a main scanning direction. Further, the first imaging device 125*a* includes a lens for forming an image on the imaging element, and an A/D converter for amplifying and analog-digital (A/D) converting an electric signal output from the imaging element. The first imaging device 125*a* generates and outputs an input image imaging a back side of a conveyed medium.

Similarly, the second imaging device 125*b* includes a reduction optical system type line sensor including an imaging element based on CCDs linearly located in the main scanning direction. Further, the second imaging device 125*b* includes a lens for forming an image on the imaging element, and an A/D converter for amplifying and A/D converting an electric signal output from the imaging element. The second imaging device 125*b* generates and outputs an input image imaging a front side of a conveyed medium.

Only either of the first imaging device 125*a* and the second imaging device 125*b* may be located in the medium conveying apparatus 100 and only one side of a medium may be read. Further, a unity-magnification optical system type contact image sensor (CIS) including an imaging element based on a complementary metal oxide semiconductor (CMOS) may be used in place of the imaging element based on CCDs.

A medium placed on the medium tray 103 is conveyed between the lower guide 108*a* and the upper guide 108*b* in the medium conveying direction A1 by the feed rollers 116 rotating in the direction of the arrow A4 in FIG. 2. When a medium is conveyed, the brake rollers 117 rotate in the direction of the arrow A3, that is, a direction opposite to the medium feeding direction. By the workings of the feed rollers 116 and the brake rollers 117, when a plurality of media are placed on the medium tray 103, only a medium in contact with the feed rollers 116, out of the media placed on the medium tray 103, is separated. Consequently, the medium conveying apparatus 100 operates in such a way that conveyance of a medium other than the separated medium is restricted (prevention of multi-feed).

A medium is fed between the first conveyance rollers 123 and the second conveyance rollers 124 while being guided by the lower guide 108*a* and the upper guide 108*b*. The medium is fed between the first imaging device 125*a* and the second imaging device 125*b* by the first conveyance rollers 123 and the second conveyance rollers 124 rotating in directions of an arrow A6 and an arrow A7, respectively. The medium read by the imaging devices 125 is ejected on the ejection tray 104 by the third conveyance rollers 126 and the fourth conveyance rollers 127 rotating in directions of an arrow A8 and an arrow A9, respectively.

Figure 3:
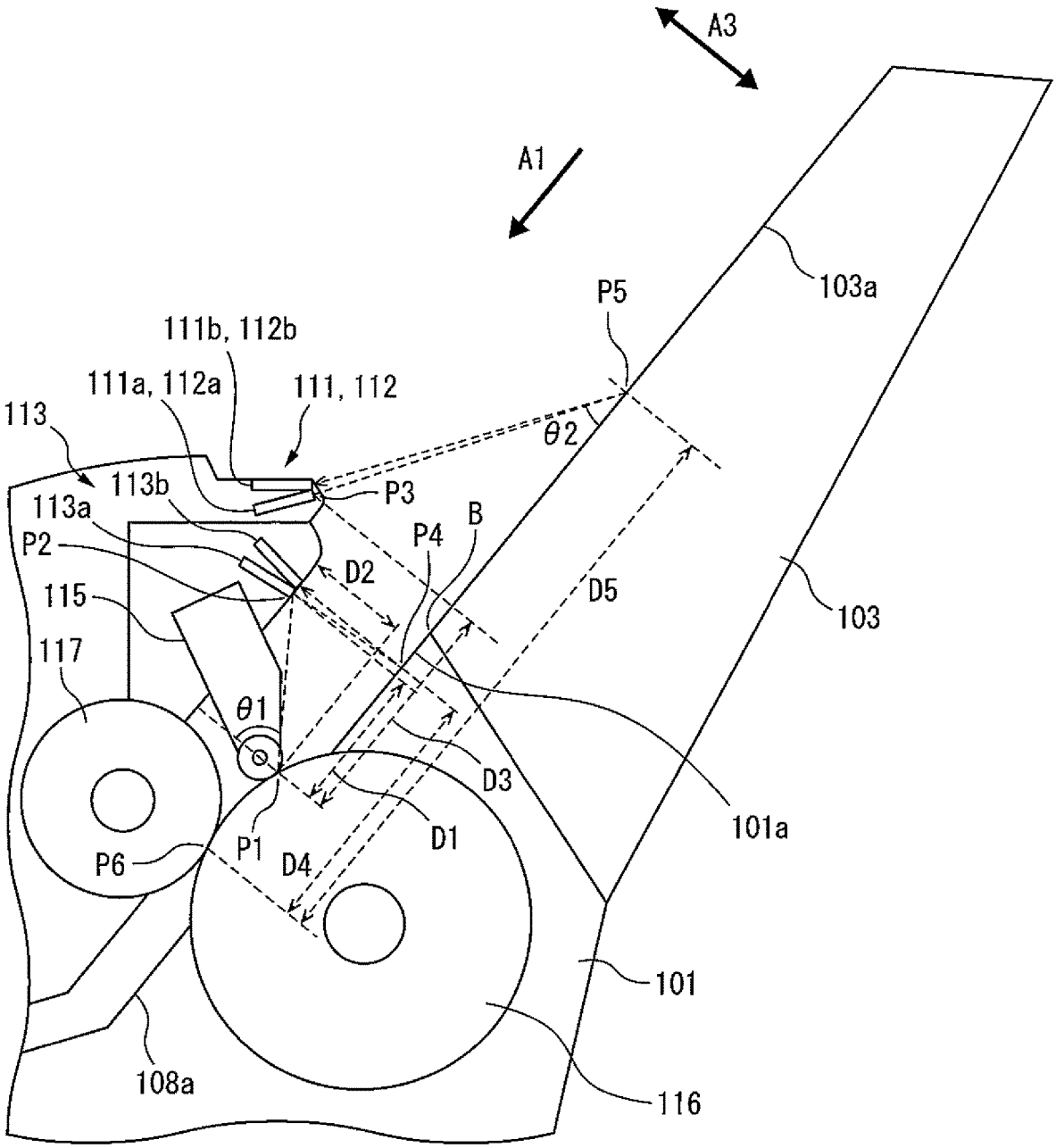
FIG. 3 is a schematic diagram for illustrating each optical sensor.
Figure 4:
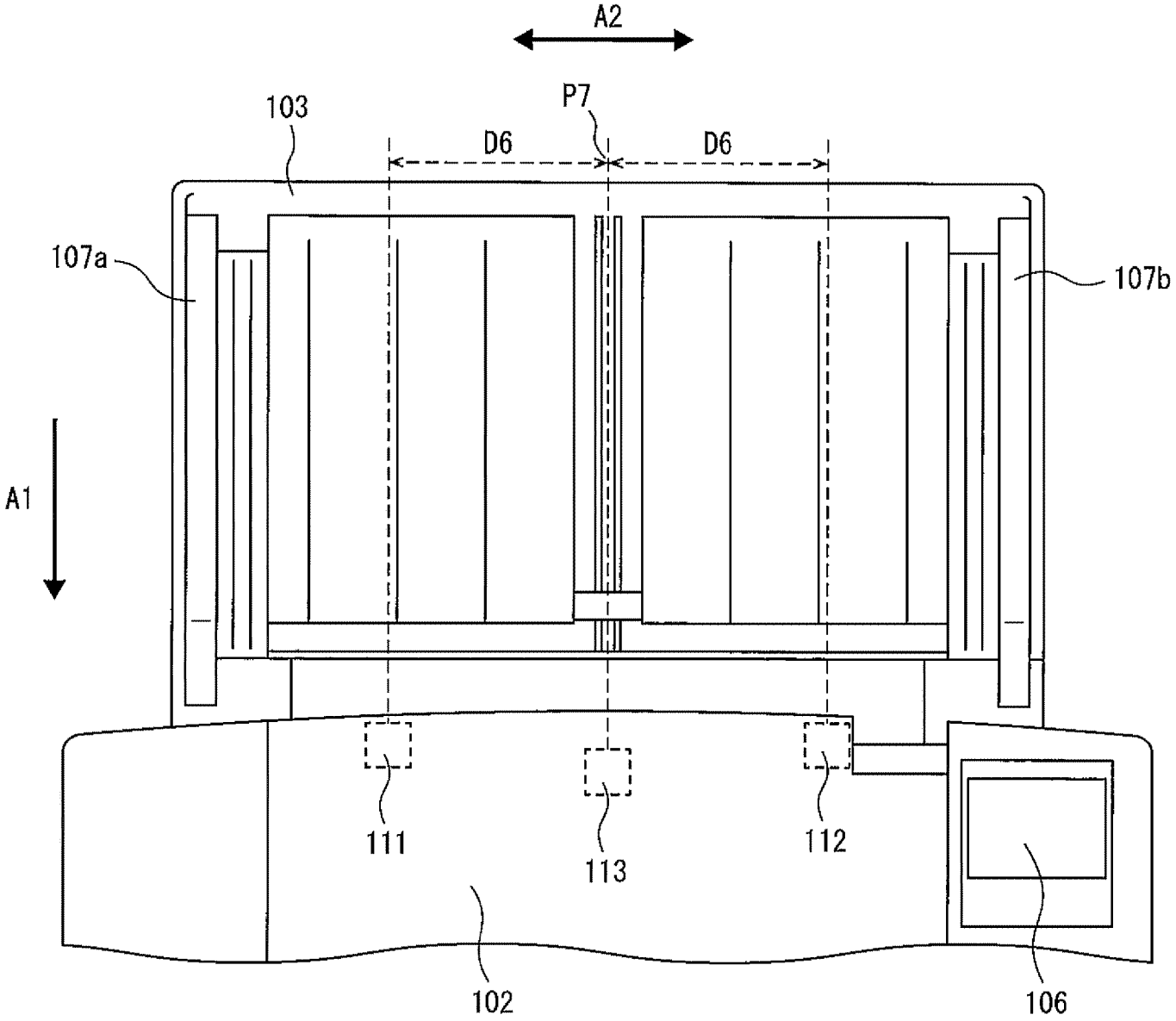
FIG. 4 is a schematic diagram for illustrating each optical sensor.

FIG. 3 and FIG. 4 are schematic diagrams for illustrating the second optical sensors 111 and 112, and the first optical sensor 113. FIG. 3 is a schematic diagram of the upstream side of the medium conveying apparatus 100 viewed from side in a state in which the side guides 107 are removed. FIG. 4 is a schematic diagram of the upstream side of the medium conveying apparatus 100 viewed from above.

As illustrated in FIG. 3, the second optical sensors 111 and 112 are provided on the upper housing 102, that is, above the medium conveyance path and are located on the upstream side of the first optical sensor 113 in the medium conveying direction A1. Each of the second optical sensors 111 and 112 is an infrared access distance sensor and measures a distance from an object existing at a facing position, based on a time difference between emission and reflection of infrared rays. The second optical sensors 111 and 112 include second light emitters 111*a* and 112*a*, and second light receivers 111*b* and 112*b*, respectively. Each of the second light emitters 111*a* and 112*a* emits second light (infrared light) toward the medium tray 103 or the lower housing 101. On the other hand, each of the second light receivers 111*b* and 112*b* receives the second light emitted by each of the second light emitters 111*a* and 112*a* and reflected by the medium tray 103, the lower housing 101, or a medium placed on the medium tray 103, and generates and outputs a second signal being an electric signal based on the received light, that is, based on receiving the second light. For example, the second signal indicates a time period from a time when each of the second light emitters 111*a* and 112*a* emits second light to a time when each of the second light receivers 111*b* and 112*b* receives the second light.

For example, a known infrared access distance sensor capable of measuring a distance in a range of 0 to 100 mm with a resolution of 1 mm may be used as each of the second optical sensors 111 and 112. Only one of the second optical sensors 111 and 112 may be located and the other may not be located in the medium conveying apparatus 100.

The first optical sensor 113 is provided on the upper housing 102, that is, above the medium conveyance path and is located on the downstream side of the second optical sensors 111 and 112 in the medium conveying direction A1 and on the upstream side of the pick arm 115 in the medium conveying direction A1. The first optical sensor 113 is an infrared access distance sensor similar to the second optical sensors 111 and 112. The first optical sensor 113 includes a first light emitter 113*a* and a first light receiver 113*b*. The first light emitter 113*a* emits first light (infrared light) toward the medium tray 103 or the lower housing 101. On the other hand, the first light receiver 113*b* receives the first light emitted by the first light emitter 113*a* and reflected by the medium tray 103, the lower housing 101, or a medium placed on the medium tray 103, and generates and outputs a first signal being an electric signal based on the received light, that is, based on receiving the first light. For example, the first signal indicates a time period from a time when the first light emitter 113*a* emits first light to a time when the first light receiver 113*b* receives the first light.

The first optical sensor 113 may be located on the upstream side of the second optical sensors 111 and 112. Further, the first optical sensor 113 and the second optical sensors 111 and 112 may be located on the downstream side of the pick arm 115.

An arrangement position of the second optical sensors 111 and 112, and the first optical sensor 113 will be described in detail below.

The second optical sensors 111 and 112, and the first optical sensor 113 are located on the upper housing 102 at positions facing the conveyance surface 101*a*. For example, the first optical sensor 113 is located at a position P2 on the upstream side of a contact position P1 of the pick arm 115 and the feed rollers 116 by a predetermined distance D1 in the medium conveying direction A1. For example, the predetermined distance D1 is greater than or equal to 5 mm and less than or equal to 30 mm. When a distance D2 between the contact position P1 and the arrangement position P2 of the first optical sensor 113 in the direction A3 perpendicular to the conveyance surface 101*a* is 15 mm, an angle θ1 formed by the direction A3 and a straight line from the contact position P1 toward the arrangement position P2 is greater than or equal to 18° and less than or equal to 70°. Consequently, the first light emitter 113*a* can efficiently emit the first light toward the downstream side of a medium placed on the medium tray 103, and the first light receiver 113*b* can efficiently receive the first light reflected by the medium.

On the other hand, the second optical sensors 111 and 112 are located at a position P3 on the upstream side of the contact position P1 of the pick arm 115 and the feed rollers 116 by a predetermined distance D3 in the medium conveying direction A1. The predetermined distance D3 is greater than the predetermined distance D1 and is, for example, greater than or equal to 10 mm and less than or equal to 50 mm. Consequently, the second light emitters 111*a* and 112*a* can efficiently emit the second light toward the upstream side of a position to which the first light emitter 113*a* emits the first light, and the second light receivers 111*b* and 112*b* can efficiently receive the second light reflected by a medium.

Further, the first light emitter 113*a* is provided to emit the first light toward the downstream side of a medium placed on the medium tray 103 in the medium conveying direction A1. For example, the first light emitter 113*a* emits the first light toward a predetermined position P4 in the conveyance surface 101*a*, that is, toward the downstream side of a boundary position B between the conveyance surface 101*a* and the placement surface 103*a*. In other words, the first light emitter 113*a* emits the first light toward the downstream side of a position corresponding to the boundary position B (a position where a straight line connecting the first light emitter 113*a* to the boundary position B passes) on a medium placed on the medium tray 103.

A medium placed on the medium tray 103 is pressed by the pick arm 115 and therefore hardly bends on the downstream side of the pick arm 115. Accordingly, it is preferable that the first light emitter 113*a* be provided to emit the first light toward a position on the upstream side of the pick arm 115.

On the other hand, the second light emitters 111*a* and 112*a* are provided to emit the second light toward the upstream side of a medium placed on the medium tray 103 in the medium conveying direction A1. The second light emitters 111*a* and 112*a* emit the second light toward a position on the upstream side of the position P4 to which the first light emitter 113*a* emits the first light on a medium placed on the medium tray 103. Particularly, the second light emitters 111*a* and 112*a* emit the second light toward a predetermined position P5 in the placement surface 103*a*, that is, toward the upstream side of the boundary position B between the conveyance surface 101*a* and the placement surface 103*a*. Specifically, the second light emitters 111*a* and 112*a* emit the second light toward the upstream side of a position corresponding to the boundary position 13 on a medium placed on the medium tray 103 (a position where a straight line connecting each of the second light emitters 111*a* and 112*a* to the boundary position B passes).

Further, the second light emitters 111*a* and 112*a* are provided in such a way that an angle θ2 formed by the placement surface 103*a* and a light emission direction of each of the second light emitters 111*a* and 112*a* is greater than a predetermined angle (for example, 10°). Consequently, each of the second light receivers 111*b* and 112*b* can reliably receive the second light emitted by each of the second light emitters 111*a* and 112*a* and reflected by a medium placed on the medium tray 103. Similarly, the first light emitter 113*a* is provided in such a way that an angle formed by the conveyance surface 101*a* and a light emission direction of the first light emitter 113*a* is greater than a predetermined angle. Consequently, the first light receiver 113*b* can reliably receive the first light emitted by the first light emitter 113*a* and reflected by a medium placed on the medium tray 103.

The first optical sensor 113 is used for detecting a folding occurring when a medium the center of which is bound by a seam part, such as a passport in an opened state, is fed in such a way that the seam part is perpendicular to the medium conveying direction A1. The folding includes a bending. When such a medium is fed, a folding occurs on the downstream side of the seam part in the medium conveying direction A1. Accordingly, the first light emitter 113*a* may be provided to emit the first light toward the downstream side of the seam part of the passport placed on the medium tray 103 in such a way that the seam part is perpendicular to the medium conveying direction A1. In that case, a distance D4 in the medium conveying direction A1 between a nip position P6 of the feed rollers 116 and the brake rollers 117 and the position P4 to which the first light emitter 113*a* emits the first light is determined within a range of a length of a page of a passport in a widthwise direction (88 mm).

On the other hand, the second optical sensors 111 and 112 are used for detecting a folding occurring when a medium one end of which is bound by a seam part, such as a brochure in a closed state, is fed in such a way that the seam part is parallel with the medium conveying direction A1. When such a medium is fed, a folding occurs at an end facing the seam part (an end on the open side) near the central position in the medium conveying direction A1. Accordingly, the second light emitters 111*a* and 112*a* may be provided to emit the second light toward a range within a predetermined distance in the medium conveying direction A1 from the center position of a medium with a predetermined size placed on the medium tray 103, on the upstream side of the position to which the first light emitter 113*a* emits the first light. For example, the predetermined size includes A3 to A6 sizes. For example, the predetermined distance is 50 mm.

Considering a case of an A4-size brochure bound along a longitudinal direction being determined as a folding detection target, a length of an A4-size medium in a lengthwise direction is 297 mm, and a length from an end to the center position in the longitudinal direction is 148.5 mm. In that case, a distance D5 from the nip position P6 to the position P5 to which the second light emitters 111*a* and 112*a* emit the second light in the medium conveying direction A1 is determined to be within a range from 98.5 mm to 198.5 mm.

Further, as illustrated in FIG. 4, the first optical sensor 113 is located in the central part of the upper housing 102 in the direction A2 perpendicular to the medium conveying direction. On the other hand, the second optical sensors 111 and 112 are located outside the first optical sensor 113, that is, on a side of the first optical sensor 113 on the upper housing 102 in the direction A2 perpendicular to the medium conveying direction.

As described above, the first optical sensor 113 is used for detecting a folding occurring when a medium the center of which is bound by a seam part is fed in such a way that the seam part is perpendicular to the medium conveying direction A1. Since the folding occurs along the direction A2 perpendicular to the medium conveying direction, the first optical sensor 113 can satisfactorily detect the folding as long as the first optical sensor 113 is located at any position where the medium passes. In general, a user is highly likely to place a medium in the central part in the direction A2 perpendicular to the medium conveying direction, and therefore it is preferable that the first optical sensor 113 be located at a position close to the center in the direction A2 perpendicular to the medium conveying direction. Consequently, even when a small medium is fed, the first optical sensor 113 can satisfactorily detect a folding occurring on the medium.

Further, as described above, the second optical sensors 111 and 112 are used for detecting a folding occurring when a medium bound by a seam part is fed in such a way that the seam part is parallel with the medium conveying direction A1. When such a medium is fed, a folding occurs at an end facing the seam part (an end on the open side). Accordingly, it is preferable that the second optical sensors 111 and 112 be located close to an end of a medium with a predetermined size placed on the medium tray 103 in the direction A2 perpendicular to the medium conveying direction. For example, the predetermined size includes A3 to A6 sizes. For example, a position close to an end ranges from a position apart from the end by a first distance to a position apart from the end by a second distance. For example, the first distance is 5 mm, and the second distance is 50 mm.

Considering a case of an A4-size brochure bound along a longitudinal direction being determined as a folding detection target, a length of an A4-size medium in a widthwise direction is 210 mm, and a length from the center position to an end in a widthwise direction is 105 mm. In that case, the second optical sensors 111 and 112 are v within a range in which a distance D6 from the center position P7 in the direction A2 perpendicular to the medium conveying direction is greater than or equal to 55 mm and less than or equal to 100 mm.

On the other hand, the first optical sensor 113 is used for detecting a folding occurring inside an area on a fed medium where the second optical sensors 111 and 112 detect a folding. Accordingly, the first optical sensor 113 is located inside the second optical sensors 111 and 112 in the direction A2 perpendicular to the medium conveying direction. Considering a case of an A4-size brochure bound along a longitudinal direction being determined as a target, the first optical sensor 113 is located in a range in which a distance from the center position P7 in the direction A2 perpendicular to the medium conveying direction is less than 55 mm.

Figure 5:
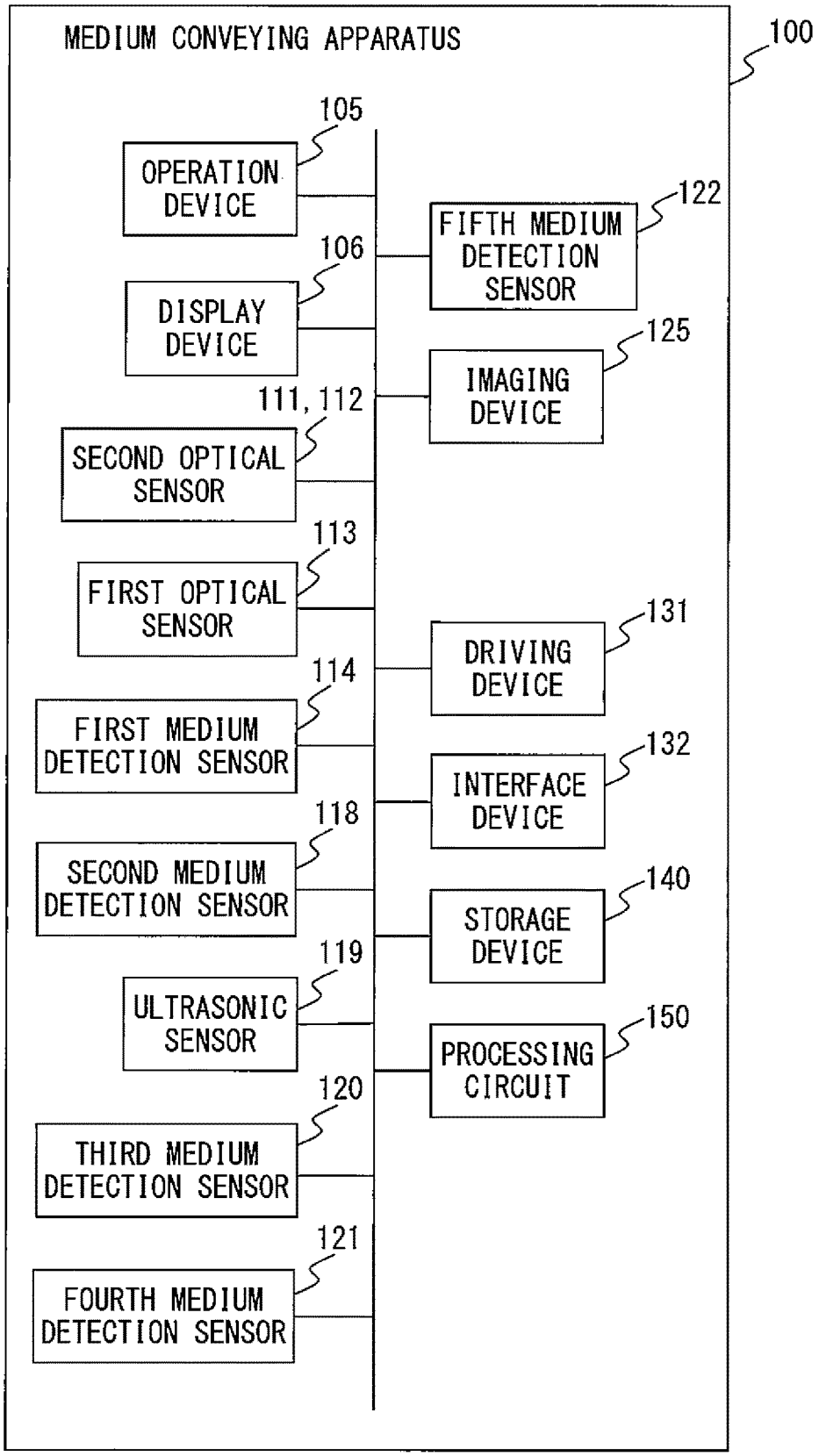
FIG. 5 is a block diagram illustrating a schematic configuration of the medium conveying apparatus 100.

FIG. 5 is a block diagram illustrating a schematic configuration of the medium conveying apparatus 100.

The medium conveying apparatus 100 further includes a driving device 131, an interface device 132, a storage device 140, and a processing circuit 150, etc., in addition to the configuration described above.

The driving device 131 includes one or a plurality of motors, and conveys a medium by rotating the feed rollers 116, the brake rollers 117, and the first to fourth conveyance rollers 123, 124, 126, and 127, by a control signal from the processing circuit 150. Further, the driving device 131 raises or lowers the pick arm 115 in accordance with a control signal from the processing circuit 150.

For example, the interface device 132 includes an interface circuit conforming to a serial bus such as universal serial bus (USB), is electrically connected to an unillustrated information processing device (for example, a personal computer or a mobile information terminal), and transmits and receives an input image and various types of information. Further, a communication module including an antenna transmitting and receiving wireless signals, and a wireless communication interface device for transmitting and receiving signals through a wireless communication line in conformance with a predetermined communication protocol may be used in place of the interface device 132. For example, the predetermined communication protocol is a wireless local area network (LAN).

The storage device 140 includes a memory device such as a random access memory (RAM) or a read only memory (ROM), a fixed disk device such as a hard disk, or a portable storage device such as a flexible disk or an optical disk. Further, the storage device 150 stores a computer program, a database, a table, etc., used for various types of processing in the medium conveying apparatus 100. The computer program may be installed on the storage device 140 from a computer-readable, non-transitory medium such as a compact disk read only memory (CD-ROM), a digital versatile disk read only memory (DVD-ROM), etc., by using a well-known setup program, etc.

For example, the processing circuit 150 is a processor, such as a central processing unit (CPU). The processing circuit 150 operates in accordance with a program previously stored in the storage device 140. The processing circuit 150 may be a digital signal processor (DSP), a large scale integration (LSI), an application specific integrated circuit (ASIC), a field-programmable gate array (FPGA), etc.

The processing circuit 150 is connected to the operation device 105, the display device 106, the second optical sensors 111 and 112, the first optical sensor 113, the first medium detection sensor 114, the second medium detection sensor 118, the ultrasonic sensor 119, the third medium detection sensor 120, the fourth medium detection sensor 121, the fifth medium detection sensor 122, the imaging devices 125, the driving device 131, the interface device 132, the storage device 140, the processing circuit 160, etc., and controls each of these units. The processing circuit 150 performs drive control of the driving device 131, imaging control of the imaging devices 125, etc., acquires an image, and transmits the image to the information processing device through the interface device 142. Further, the processing circuit 150 detects a folding of a fed medium based on a signal generated by the first optical sensor 113 or the second optical sensors 111 and 112, and stops feed of the medium depending on the detection result.

The processing circuit 160 executes predetermined image processing on an image imaged by the imaging device 125 and stores the image on which the image processing is executed into the storage device 140. A DSP, an LSI, an ASIC, an FPGA, etc., may be used in place of the processing circuit 160.

Figure 6:
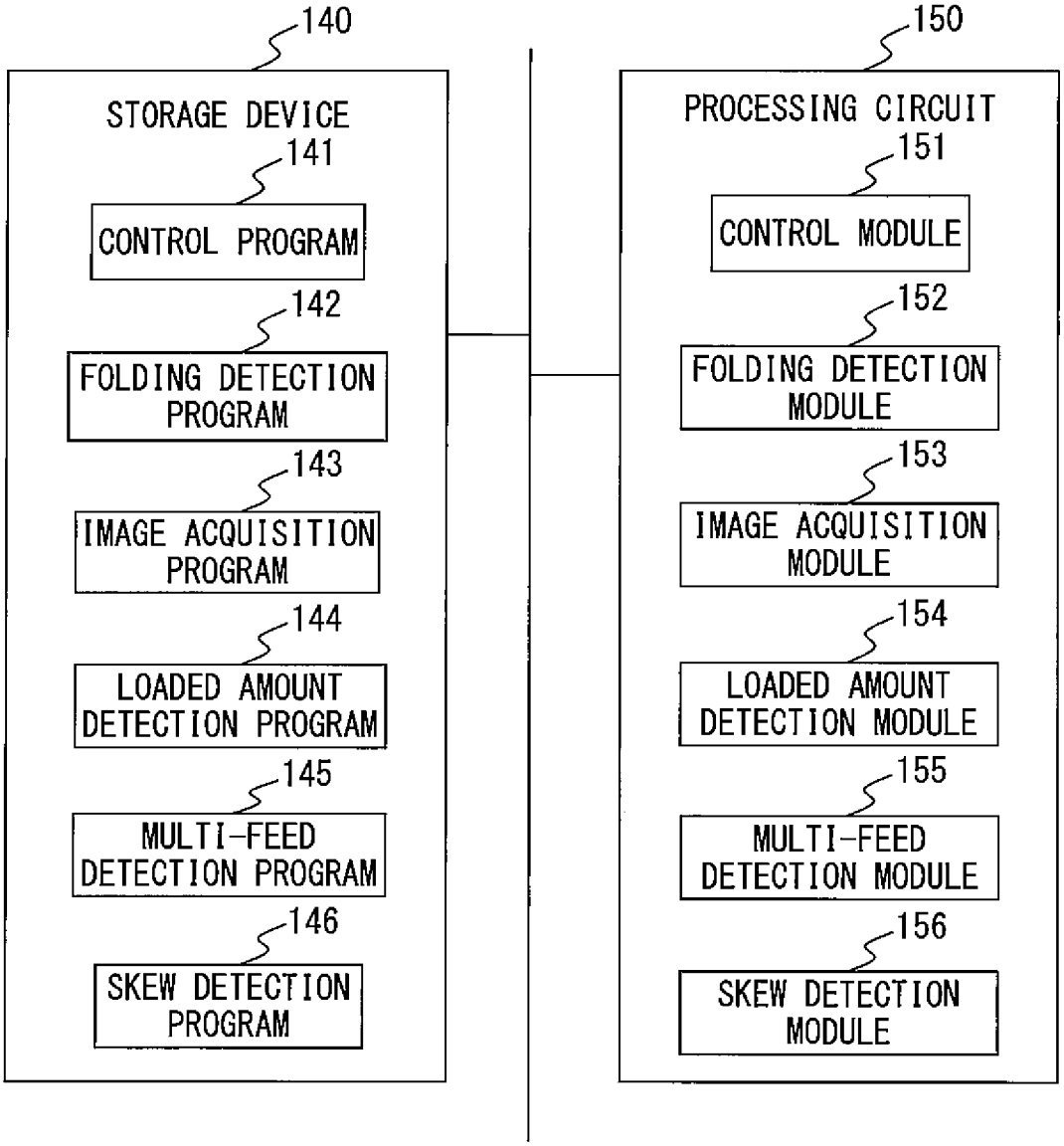
FIG. 6 is a diagram illustrating a schematic configuration of a storage device 140 and a processing circuit 150.

FIG. 6 is a diagram illustrating schematic configurations of the storage device 140 and the processing circuit 150.

As illustrated in FIG. 6, the storage device 140 stores a control program 141, a folding detection program 142, an image acquisition program 143, a loaded amount detection program 144, a multi-feed detection program 145, a skew detection program 146, etc. Each of these programs is a functional module implemented by software operating on a processor. The processing circuit 150 reads each program stored in the storage device 140 and operates in accordance with each read program. Consequently, the processing circuit 150 functions as a control module 151, a folding detection module 152, an image acquisition module 153, a loaded amount detection module 154, a multi-feed detection module 155, and the skew detection module 156.

Figure 7:
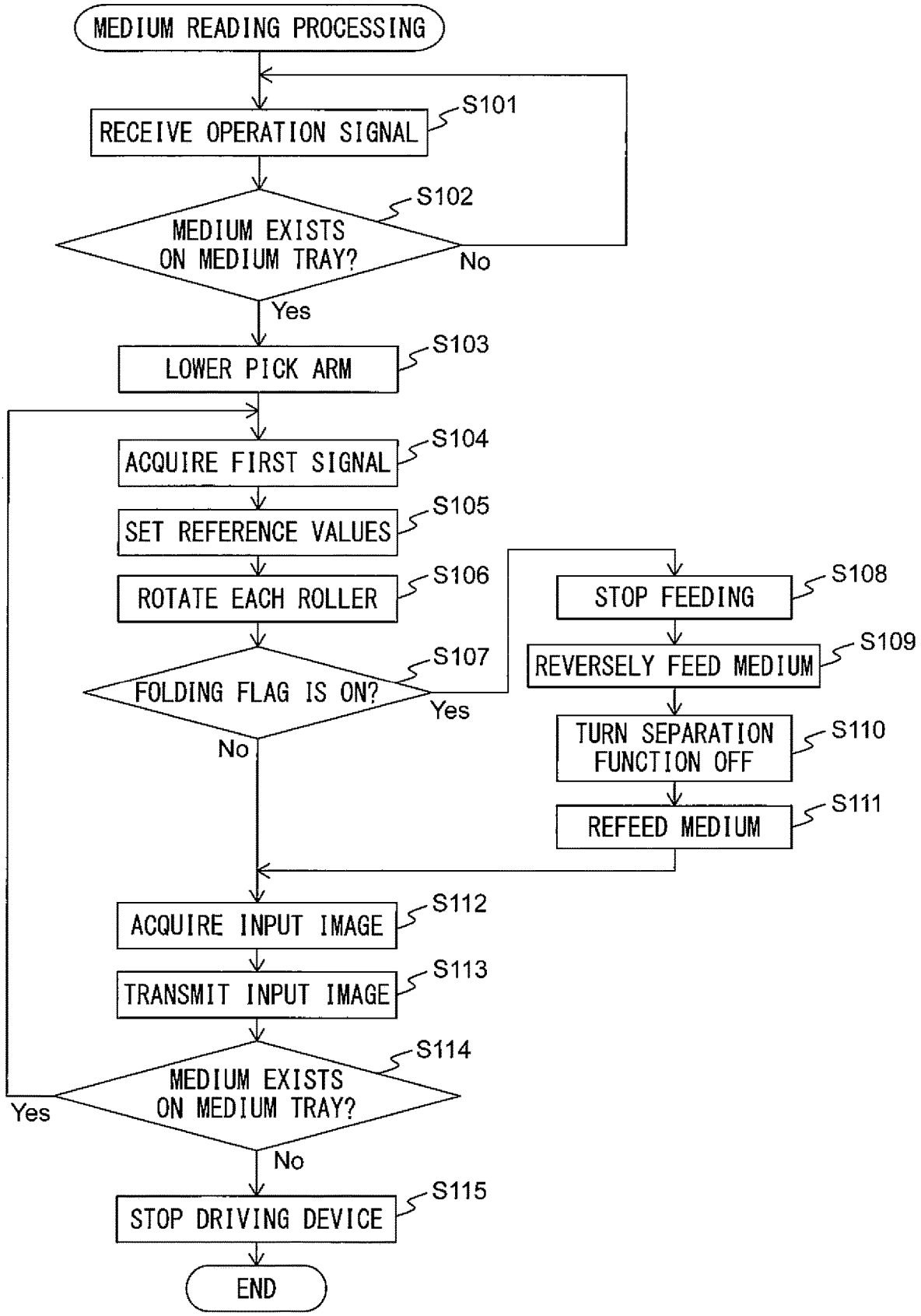
FIG. 7 is a flowchart illustrating an operation example of medium reading processing.

FIG. 7 is a flowchart illustrating an operation example of medium reading processing in the medium conveying apparatus 100.

Referring to the flowchart illustrated in FIG. 7, an operation example of the medium reading processing in the medium conveying apparatus 100 will be described below. The operation flow described below is executed mainly by the processing circuit 150 in cooperation with each element in the medium conveying apparatus 100, in accordance with a program previously stored in the storage device 140. The operation flow illustrated in FIG. 7 is periodically executed.

First, the control module 151 stands by until an instruction to read a medium is input by a user by use of the operation device 105, and an operation signal instructing to read the medium is received from the operation device 105 (step S101).

Next, the control module 151 acquires a first medium detection signal from the medium detection sensor 111 and determines whether or not a medium is placed on the medium tray 103, based on the acquired first medium detection signal (step S102).

When a medium is not placed on the medium tray 103, the control module 151 returns the processing to step S101 and stands by until newly receiving an operation signal from the operation device 105.

On the other hand, when a medium is placed on the medium tray 103, the control module 151 drives the driving device 131 and causes the pick arm 115 to descend and press the medium placed on the medium tray 103 (step S103).

Next, the control module 151 acquires a first signal from the first optical sensor 113 (step S104). The control module 151 acquires a first signal at a timing immediately before feeding of the medium. The timing immediately before feeding of the medium is an example of a predetermined timing.

Next, the control module 151 sets a first reference value and a second reference value based on a signal value of the acquired first signal (step S105). For example, the control module 151 sets the signal value of the acquired first signal to the first reference value and sets a value acquired by multiplying the signal value of the first signal by a predetermined coefficient to the second reference value. The predetermined coefficient is set to a ratio of a distance between each of the second optical sensors and a position on the medium conveying apparatus 100 to which the second light is emitted by each of the second optical sensors to a distance between the first optical sensor 113 and a position on the medium conveying apparatus 100 to which the first light is emitted by the first optical sensor 113.

The front edge of a medium is pressed by the pick arm 115 at a timing immediately before feeding of the medium, and therefore even when the front edge of a fed medium is curved (curled), the curved part becomes straight. Further, the first optical sensor 113 emits the first light toward the downstream side of a medium, and the emitted light is less likely to be blocked by a hand of a user setting the medium. Accordingly, by setting each reference value based on a signal value of a first signal acquired immediately before feeding of the medium, the control module 151 can suppress the reference values being set to improper values due to an effect of a state of the medium or a user operation.

Next, the control module 151 drives the driving device 131, rotates the feed rollers 116, the brake rollers 117, and the first to fourth conveyance rollers 123, 124, 126, and 127, and feeds and conveys the medium (step S106). When successively feeding and conveying a plurality of media and already rotating each roller, the control module 151 does not particularly execute processing.

Next, the control module 151 determines whether or not a folding flag is ON (step S107). The folding flag is set to OFF before the medium reading processing is executed and is set to ON when occurrence of a folding is determined in folding detection processing, to be described later, executed by the folding detection module 152.

When the folding flag is ON, the control module 151 stops the driving device 131 and stops feeding of a medium, and also sets the folding flag to OFF, as abnormality processing (step S108). Thus, depending on a detection result of the folding detection module 152, the control module 151 stops feeding of a medium by the feed rollers 116 and the brake rollers 117.

Next, the control module 151 drives the driving device 131 and causes the feed rollers 116, the brake rollers 117, the first to fourth conveyance rollers 123, 124, 126, and 127 to rotate in a direction opposite to the medium conveying direction and reversely feed the medium (step S109). Thus, when stopping feeding of a medium by the feed rollers 116 and the brake rollers 117, the control module 151 temporarily resets the medium to the medium tray 103.

Next, the control module 151 switches the driving force transmission mechanism provided between the driving device 131 and the brake rollers 117, interrupts a driving force from the driving device 131 to the brake rollers 117, and turns the separation function OFF (step S110). The control module 151 may switch the driving force transmission mechanism provided between the driving device 131 and the brake rollers 117, reduce a separating force by the brake rollers 117, and turn the separation function OFF.

Next, the control module 151 drives the driving device 131 and causes the feed rollers 116 and the first to fourth conveyance rollers 123, 124, 126, and 127 to re-rotate in the medium conveying direction, and refeed and re-convey the medium (step S111). At this time, the brake rollers 117 are driven by the feed rollers 116 and do not separate media. Thus, the control module 151 controls the feed rollers 116 and the brake rollers 117 in such a way that the rollers refeed the media without separation. In other words, when a medium folded in two, a bound medium, etc., is fed, and a folding of the medium is detected, the control module 151 automatically turns the separation function OFF and refeeds the medium. Consequently, a user does not need to turn the separation function OFF and refeed the medium, and therefore the control module 151 can improve user convenience.

When the folding flag is OFF in step S107 or when a medium is refed in step S111, the image acquisition module 153 causes the imaging device 125 to image the conveyed medium and acquires an input image (step S112).

Next, the image acquisition module 153 transmits the input image to the unillustrated information processing device through the interface device 132 (step S113). When not being connected to the information processing device, the image acquisition module 153 stores the input image in the storage device 140.

Next, the control module 151 determines whether or not a medium remains on the medium tray 103 based on a first medium detection signal acquired from the first medium detection sensor 114 (step S114). When a medium remains on the medium tray 103, the control module 151 returns the processing to step S104 and repeats the processing in steps S104 to S114.

On the other hand, when a medium does not remain on the medium tray 103, the control module 151 stops the driving device 131 (step S115) and ends the series of steps.

In steps S104 and S105, the control module 151 may set the first reference value and the second reference value to predetermined fixed values.

Further, the control module 151 may omit the processing in steps S109 to S111 and after stopping feeding of the medium, may notify occurrence of an abnormality to a user by an unillustrated speaker, LED, etc., and end the series of steps.

Figure 8:
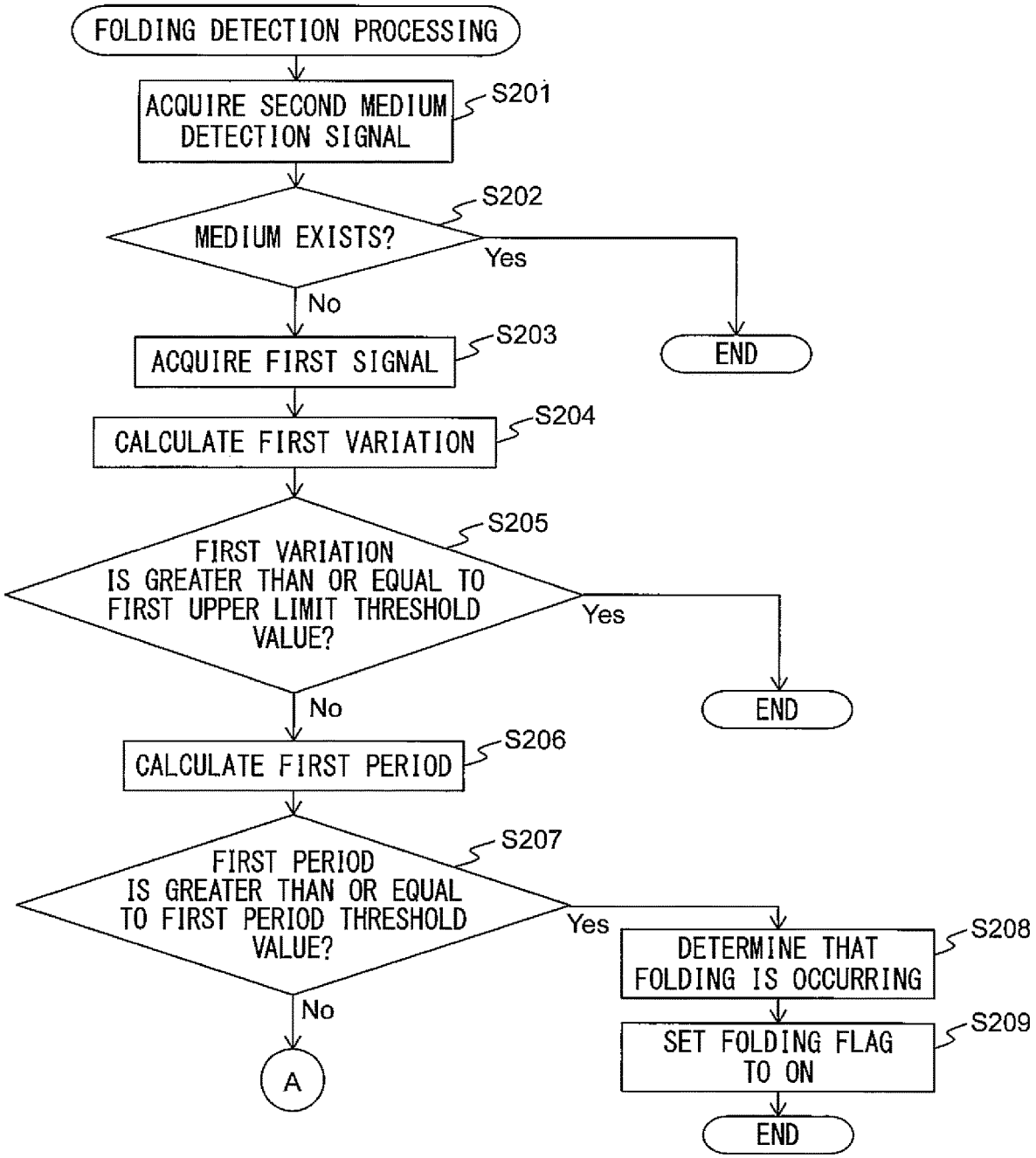
FIG. 8 is a flowchart illustrating an operation example of folding detection processing.
Figure 9:
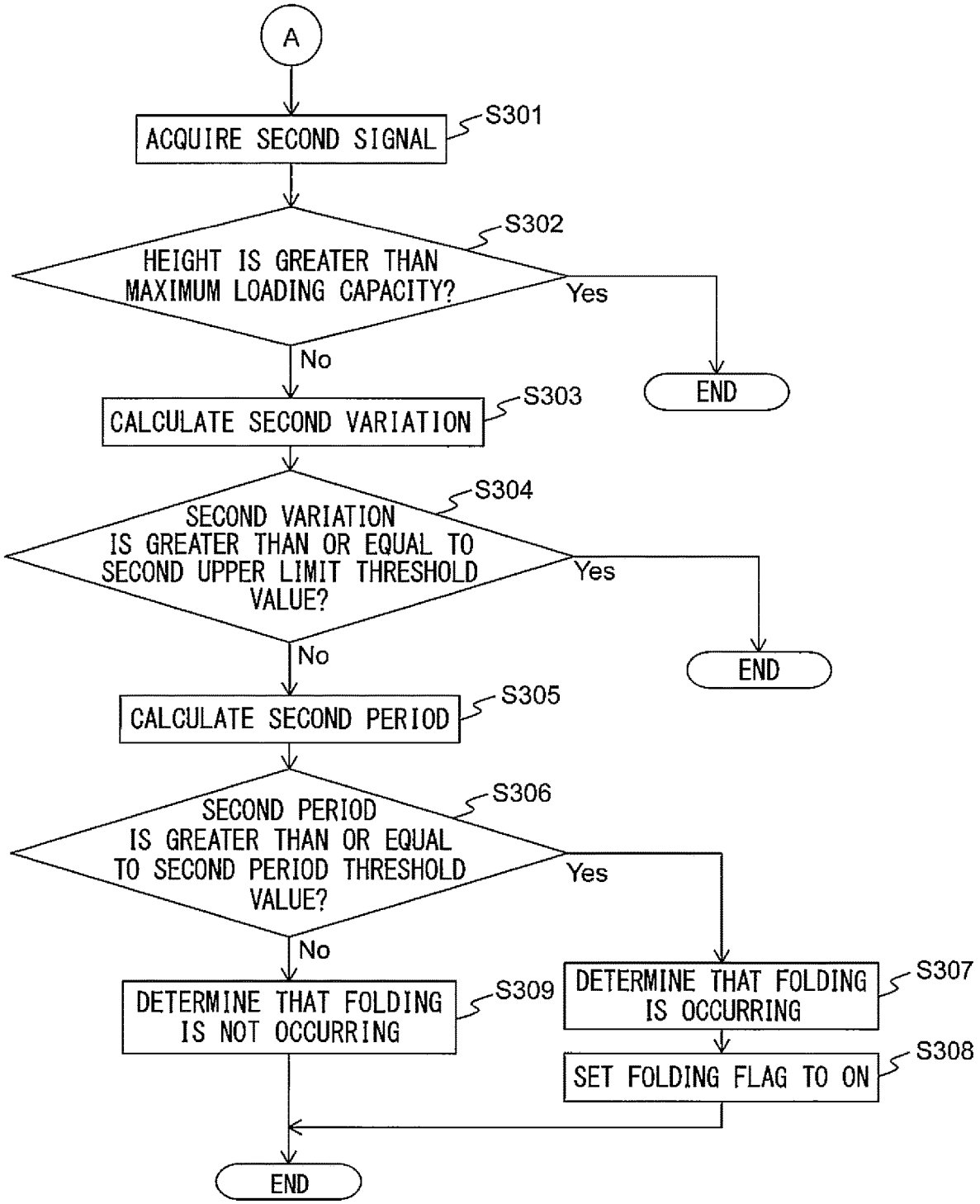
FIG. 9 is a flowchart illustrating an operation example of the folding detection processing.

FIG. 8 and FIG. 9 are flowcharts illustrating an operation example of the folding detection processing.

The operation flow described below is executed mainly by the processing circuit 150 in cooperation with each element in the medium conveying apparatus 100, in accordance with a program previously stored in the storage device 140. The flowcharts illustrated in FIG. 8 and FIG. 9 are executed at predetermined time intervals after feeding of a medium is started in step S106 in FIG. 7. By executing the folding detection processing only after starting feeding of a medium, the folding detection module 152 can prevent a detection error of a folding of a medium caused by light reflected by a hand of a user setting the medium on the medium tray 103. Further, the front edge of a medium placed on the medium tray 103 is pressed by the pick arm 115 before the folding detection processing is executed, and therefore even when the front edge of a medium is curved (curled), the curved part becomes straight. Accordingly, the folding detection module 152 can prevent a detection error of a folding of a medium caused by a curved front edge of the medium.

First, the folding detection module 152 acquires a second medium detection signal from the second medium detection sensor 118 (step S201).

Next, the folding detection module 152 determines whether or not a medium exists at a position of the second medium detection sensor 118 based on the acquired second medium detection signal (step S202).

When a medium exists at the position of the second medium detection sensor 118, the folding detection module 152 does not particularly execute processing and ends the series of steps. Thus, when a medium exists at the position of the second medium detection sensor 118, that is, in a period from a time when the front edge of a medium passes the position of the second medium detection sensor 118 to a time when the rear edge of the medium passes the position of the second medium detection sensor 118, the folding detection module 152 does not detect a folding of the medium.

In a case that the rear edge of a conveyed medium is curved (curled), when a folding of the medium is detected by use of light reflected by the rear edge, a folding may be mistakenly determined to have occurred at the time of feeding. Accordingly, it is preferable that the second light emitters 111*a* and 112*a* be provided to emit the second light toward the central part of a medium before feeding in the medium conveying direction A1, the medium being placed on the medium tray 103. As described above, the folding detection module 152 does not detect a folding of a medium when the front edge of the medium passes the nip position of the feed rollers 116 and the brake rollers 117, and reaches the position of the second medium detection sensor 118 located on the downstream side of the nip position. Consequently, the folding detection module 152 does not detect a folding of a medium based on light reflected at the rear edge of the medium, and therefore a detection error of a folding of the medium caused by light reflected at the rear edge of a medium in a curved state can be prevented.

On the other hand, when a medium does not exist at the position of the second medium detection sensor 118, the folding detection module 152 acquires a first signal from the first optical sensor 113 (step S203). Specifically, the folding detection module 152 acquires a first signal from the first optical sensor 113 at predetermined time intervals after feeding of a medium, in the folding detection processing. Each timing after feeding of a medium is an example of another timing different from the predetermined timing.

Next, the folding detection module 152 calculates a first variation based on a signal value of the acquired first signal and stores the calculated first variation into the storage device 140 (step S204). The folding detection module 152 calculates a subtracted value acquired by subtracting the signal value of the acquired first signal from the first reference value as the first variation. In other words, a first variation indicates a magnitude of a change from the first reference value to a signal value of a latest first signal.

Next, the folding detection module 152 determines whether or not the calculated first variation is greater than a first upper limit threshold value (step S205). For example, the first upper limit threshold value is previously set to a value greater than a first variation calculated when a folding of a medium occurs in an experiment of feeding various types of media.

When the first variation is greater than the first upper limit threshold value, the folding detection module 152 does not particularly execute processing and ends the series of steps. When a variation of a signal value of the first signal is greater than the first upper limit threshold value, the folding detection module 152 estimates that the first signal is generated based on light reflected by a hand of a user, etc., rather than a medium placed on the medium tray 103 and does not detect a folding of the medium. Consequently, the folding detection module 152 can prevent a detection error of a folding of a medium caused by light reflected by a hand of a user, etc.

On the other hand, when the first variation is less than or equal to the first upper limit threshold value, the folding detection module 152 calculates a first period based on each first variation stored in the storage device 140 (step S206). When a latest first variation is greater than or equal to a first lower limit threshold value and less than or equal to the first upper limit threshold value, the folding detection module 152 calculates, as a first period, a period in which the first variation is successively greater than or equal to the first lower limit threshold value and less than or equal to the first upper limit threshold value up to the latest first variation. For example, the first lower limit threshold value is previously set to a value between a first variation calculated when a folding of a medium occurs and a first variation calculated when a folding of a medium does not occur in an experiment of feeding various types of media. On the other hand, when the latest first variation is less than the first lower limit threshold value, the folding detection module 152 sets the first period to 0.

Next, the folding detection module 152 determines whether or not the calculated first period is greater than or equal to a first period threshold value (step S207). For example, the first period threshold value is previously set to a value between a first period calculated when a folding of a medium occurs and a first period calculated when a folding of a medium does not occur in an experiment of feeding various types of media.

When the first period is greater than or equal to the first period threshold value, the folding detection module 152 determines that a folding of a fed medium is occurring (step S208). Next, the folding detection module 152 sets the folding flag to ON (step S209) and ends the series of steps.

On the other hand, when the first period is less than the first period threshold value, the folding detection module 152 acquires a second signal from each of the second optical sensors 111 and 112 (step S301). Specifically, the folding detection module 152 acquires a second signal from each of the second optical sensors 111 and 112 at predetermined time intervals after feeding of a medium, in the folding detection processing. Each timing after feeding of a medium is an example of another timing different from the predetermined timing.

Next, the folding detection module 152 calculates a height of the medium placed on the medium tray 103 from the placement surface 103*a* (a height in the direction A3 perpendicular to the placement surface 103*a*) based on a signal value of each second signal acquired for each of the second optical sensors 111 and 112. The folding detection module 152 determines whether or not either of the calculated heights is greater than a maximum loading capacity of media on the medium tray 103 supported by the medium conveying apparatus 100 (step S302). For example, the medium conveying apparatus 100 stores, in the storage device 140, a table associating each signal value of the second signal with a height of media based on a relation between a signal value of the second signal and a height of a medium, the relation being acquired in a previously performed experiment. The folding detection module 152 refers to the stored table and specifies a height of the medium related to the signal value of each of the acquired second signals.

When either of the calculated heights is greater than the maximum loading capacity, the folding detection module 152 does not particularly execute processing and ends the series of steps. As described above, the height of the side guide 107 is greater than the maximum loading capacity. Accordingly, when the height of the medium detected based on the second signal is greater than the maximum loading capacity, the folding detection module 152 estimates that the second signal is generated based on light reflected by the side guide 107 rather than the medium and does not detect a folding of the medium based on the second signal. Consequently, the folding detection module 152 can prevent a detection error of a folding of a medium caused by light reflected by the side guide 107.

On the other hand, when both of the calculated heights are less than or equal to the maximum loading capacity, the folding detection module 152 calculates a second variation based on a signal value of each second signal acquired for each of the second optical sensors 111 and 112, and stores the calculated second variation into the storage device 140 (step S303). The folding detection module 152 calculates a subtracted value acquired by subtracting the signal value of the acquired second signal from the second reference value as the second variation. In other words, a second variation indicates a magnitude of a change from the second reference value to a signal value of a latest second signal.

Next, the folding detection module 152 determines whether or not either of the calculated second variations is greater than a second upper limit threshold value (step S304). For example, the second upper limit threshold value is previously set to a value greater than a second variation calculated when a folding of a medium occurs in an experiment of feeding various types of medium.

When either of the second variations is greater than the second upper limit threshold value, the folding detection module 152 does not particularly execute processing and ends the series of steps. When a variation of a signal value of the second signal is greater than the second upper limit threshold value, the folding detection module 152 estimates that the second signal is generated based on light reflected by a hand of a user, etc., rather than a medium placed on the medium tray 103 and does not detect a folding of the medium. Consequently, the folding detection module 152 can prevent a detection error of a folding of a medium caused by light reflected by a hand of a user, etc.

On the other hand, when both of the second variations are less than or equal to the second upper limit threshold value, the folding detection module 152 calculates a second period based on each second variation stored in the storage device 140 for each of the second optical sensors 111 and 112 (step S305). When a latest second variation is greater than or equal to a second lower limit threshold value and less than or equal to the second upper limit threshold value, the folding detection module 152 calculates, as a second period, a period in which the second variation is successively greater than or equal to the second lower limit threshold value and less than or equal to the second upper limit threshold value up to the latest second variation. For example, the second lower limit threshold value is previously set to a value between a second variation calculated when a folding of a medium occurs and a second variation calculated when a folding of a medium does not occur in an experiment of feeding various types of media. On the other hand, when the latest second variation is less than the second lower limit threshold value, the folding detection module 152 sets the second period to 0.

Next, the folding detection module 152 determines whether or not either of the calculated second periods is greater than or equal to a second period threshold value (step S306). For example, the second period threshold value is previously set to a value between a second period calculated when a folding of a medium occurs and a second period calculated when a folding of a medium does not occur in an experiment of feeding various types of media.

When either of the second periods is greater than or equal to the second period threshold value, the folding detection module 152 determines that a folding of a fed medium is occurring (step S307). Next, the folding detection module 152 sets the folding flag to ON (step S308) and ends the series of steps.

On the other hand, when both of the second periods are less than the second period threshold value, the folding detection module 152 determines that a folding of a fed medium is not occurring (step S309) and ends the series of steps.

Thus, the folding detection module 152 detects a folding of a medium based on at least either of a first signal generated by the first optical sensor 113 or second signals generated by the second optical sensors 111 and 112. Particularly, the folding detection module 152 detects a folding of a medium by comparing a signal value of a first signal at a timing immediately before feeding of the medium with a signal value of the first signal or a signal value of the second signal at each timing after feeding of the medium.

The folding detection module 152 may omit the processing in steps S201 and S202, and detect a folding of a medium regardless of whether or not a medium exists at the position of the second medium detection sensor 118. Alternatively, the folding detection module 152 may acquire a fifth medium detection signal from the fifth medium detection sensor 122 in step S201 and determine whether or not a medium exists at a position of the fifth medium detection sensor 122 based on the fifth medium detection signal in step S202. In that case, when a medium exists at the position of the fifth medium detection sensor 122, the folding detection module 152 does not detect a folding of the medium.

Further, the folding detection module 152 may omit the processing in step S205 and detect a folding of a medium regardless of whether or not a first variation is greater than the first upper limit threshold value. Similarly, the folding detection module 152 may omit the processing in step S304 and detect a folding of a medium regardless of whether or not a second variation is greater than the second upper limit threshold value. Further, the folding detection module 152 may omit the processing in step S302 and detect a folding of a medium regardless of whether or not a calculated height is greater than the maximum loading capacity.

Figure 10:
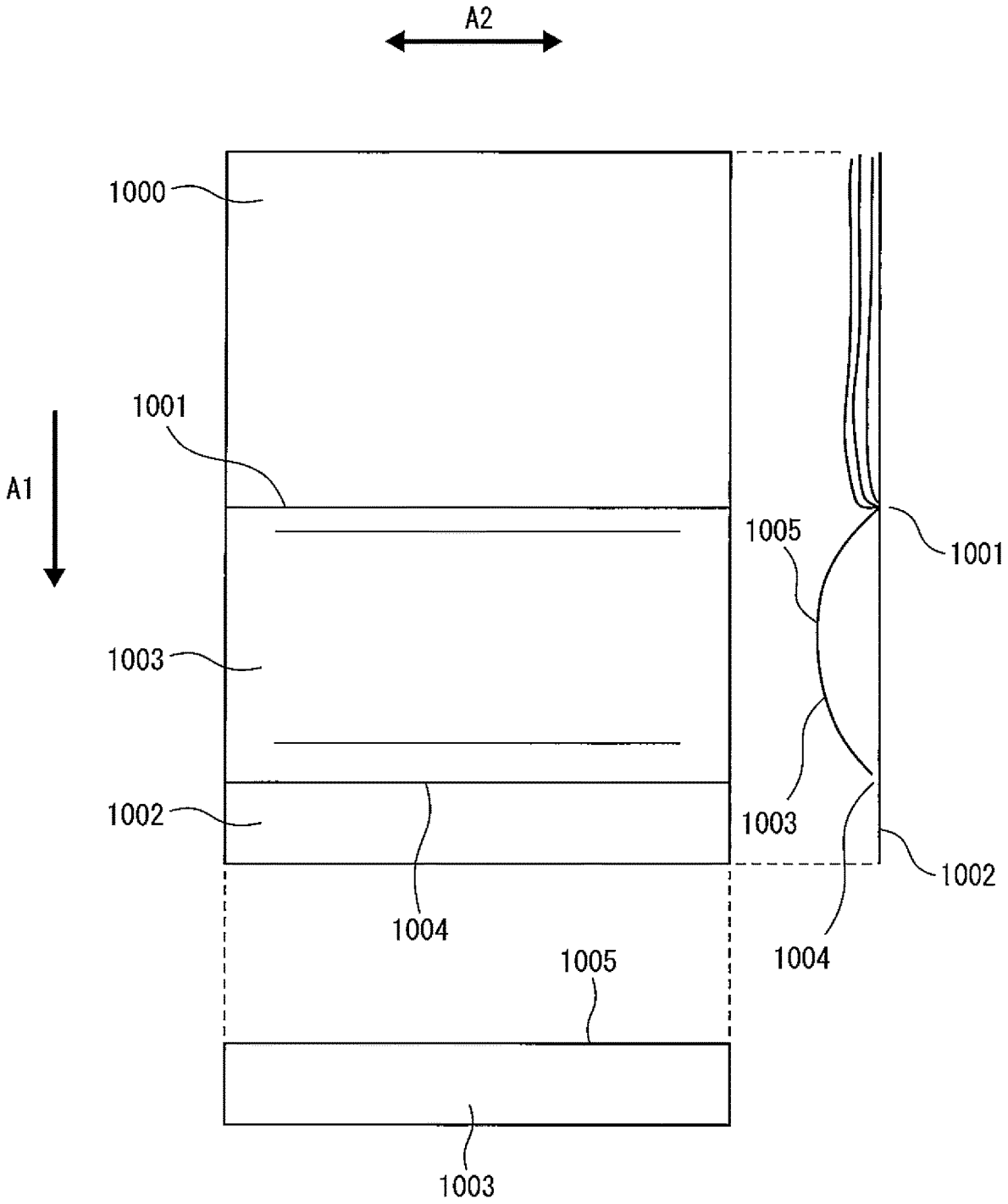
FIG. 10 is a schematic diagram for illustrating a technical meaning of detecting a folding of a medium.
Figure 11:
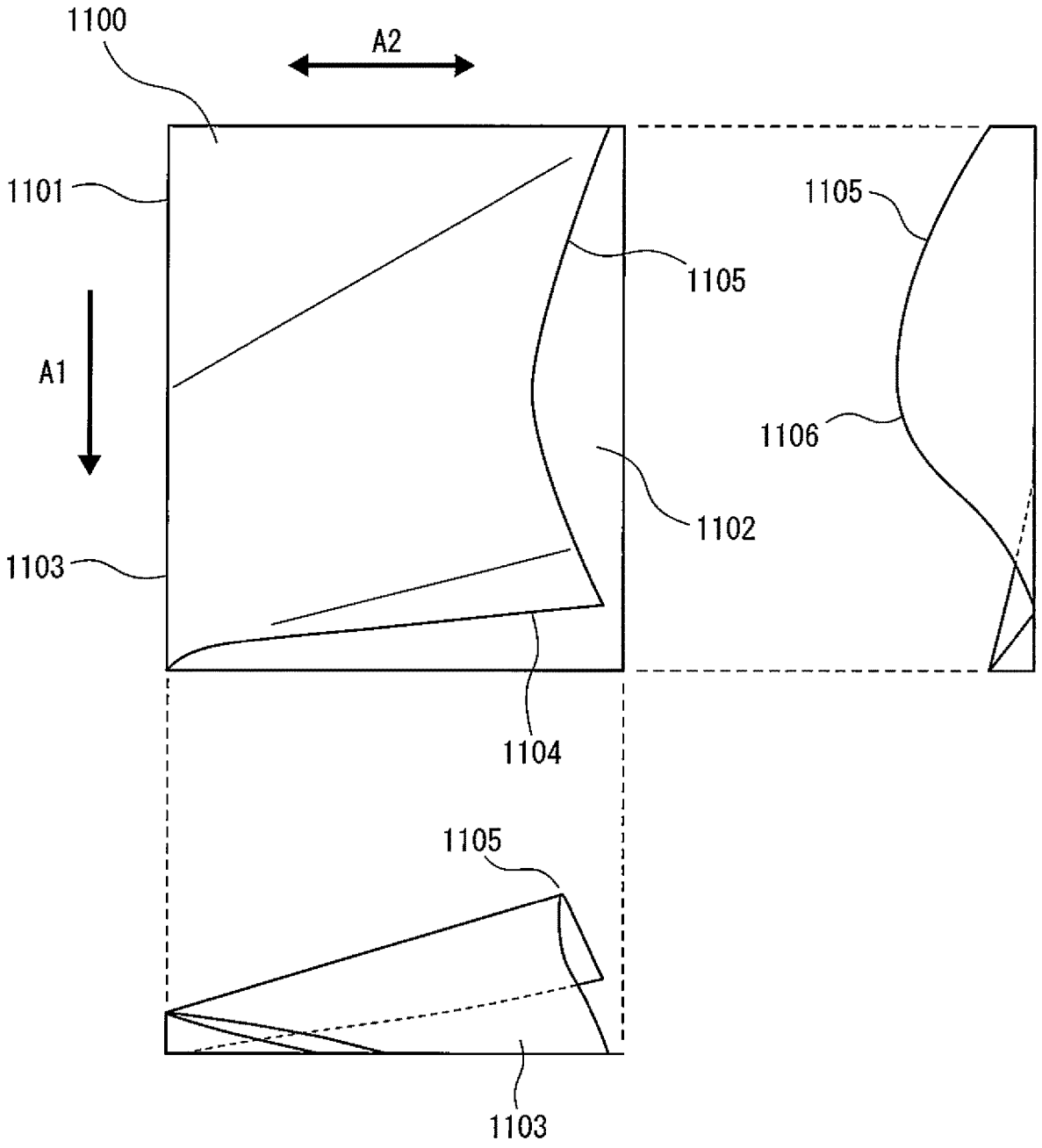
FIG. 11 is a schematic diagram for illustrating the technical meaning of detecting a folding of a medium.

FIG. 10 and FIG. 11 are schematic diagrams for illustrating a technical meaning of detecting a folding of a medium.

FIG. 10 is a schematic diagram for illustrating a case of a passport 1000 in an opened state being fed in such a way that a seam part 1001 of the passport 1000 is perpendicular to the medium conveying direction A1. The upper-left diagram in FIG. 10 is a schematic diagram of the fed passport 1000 viewed from above the medium conveying apparatus 100. The upper-right diagram in FIG. 10 is a schematic diagram of the fed passport 1000 viewed from the side of the medium conveying apparatus 100. The lower-left diagram in FIG. 10 is a schematic diagram of the fed passport 1000 viewed from the downstream side in the medium conveying direction A1.

As illustrated in FIG. 10, when the passport 1000 in an opened state is fed in such a way that the seam part 1001 of the passport 1000 is perpendicular to the medium conveying direction A1, pages on the front edge side of the passport 1000 are separated by the feed rollers 116 and the brake rollers 117. Specifically, out of pages of the passport 1000 on the front edge side, a page 1002 in contact with the feed rollers 116 and another page 1003 are separated. Accordingly, when the passport 1000 is fed, the front edge 1004 of the page 1003 not in contact with the feed rollers 116 remain at the position of the brake rollers 117 and the seam part 1001 moves with the page 1002 in contact with the feed rollers 116. Consequently, the central part 1005 of the page 1003 in the medium conveying direction A1, the page 1003 not being in contact with the feed rollers 116, bends upward.

The first light emitter 113*a* in the first optical sensor 113 emits the first light toward the downstream side of a medium placed on the medium tray 103 in the medium conveying direction A1, and therefore the first light emitted by the first light emitter 113*a* irradiates the central part 1005 and is reflected by the central part 1005. By the central part 1005 folding upward, a distance between the central part 1005 and the first optical sensor 113 is shortened. Consequently, as the central part 1005 bends more upward, a time taken by the first light emitted by the first light emitter 113*a* to be reflected by the central part 1005 and be received by the first light receiver 113*b* becomes shorter. Accordingly, the folding detection module 152 can detect a folding of a medium fed in such a way that a seam part 1001 is perpendicular to the medium conveying direction A1, in a short period and with high precision, based on a first signal generated by the first optical sensor 113.

FIG. 11 is a schematic diagram for illustrating a case of a brochure 1100 in a closed state being fed in such a way that a seam part 1101 of the brochure 1100 is parallel with the medium conveying direction A1. The upper-left diagram in FIG. 11 is a schematic diagram of the fed brochure 1100 viewed from above the medium conveying apparatus 100. The upper-right diagram in FIG. 11 is a schematic diagram of the fed brochure 1100 viewed from the side of the medium conveying apparatus 100. The lower-left diagram in FIG. 11 is a schematic diagram of the fed brochure 1100 viewed from the downstream side in the medium conveying direction A1.

As illustrated in FIG. 11, when the brochure 1100 in a closed state is fed in such a way that the seam part 1101 of the brochure 1100 is parallel with the medium conveying direction A1, pages of the brochure 1100 are separated by the feed rollers 116 and the brake rollers 117. Specifically, out of pages of the brochure 1100, a page 1102 in contact with the feed rollers 116 and another page 1103 are separated. Accordingly, when the brochure 1100 is fed, the front edge 1104 of the page 1103 not in contact with the feed rollers 116 remains at the position of the brake rollers 117, and the seam part 1101 moves with the page 1102 in contact with the feed rollers 116. Consequently, an end 1105 facing the seam part 1101 on the page 1103 not in contact with the feed rollers 116 bends upward with a central part 1106 in the medium conveying direction A1 at the center. When paper folded in two is fed in such a way that a crease part of the paper is parallel with the medium conveying direction A1, the paper bends similarly to the brochure 1100.

The second light emitters 111*a* and 112*a* are located outside in the direction A2 perpendicular to the medium conveying direction and emit the second light toward the upstream side of a medium placed on the medium tray 103 in the medium conveying direction A1. Accordingly, the second light emitted by each of the second light emitters 111*a* and 112*a* irradiates the central part 1106 of the end 1105 and is reflected by the central part 1106. By the central part 1106 folding upward, a distance between the central part 1106 and each of the second optical sensors 111 and 112 is shortened. Consequently, as the central part 1106 bends more upward, a time taken by the second light emitted by each of the second light emitters 111*a* and 112*a* to be reflected by the central part 1106 and be received by each of the second light receivers 111*b* and 112*b* becomes shorter. Accordingly, the folding detection module 152 can detect a folding of a medium fed in such a way that a seam part or a crease part is parallel with the medium conveying direction A1, in a short period and with high precision, based on second signals generated by the second optical sensors 111 and 112.

Figure 12A:
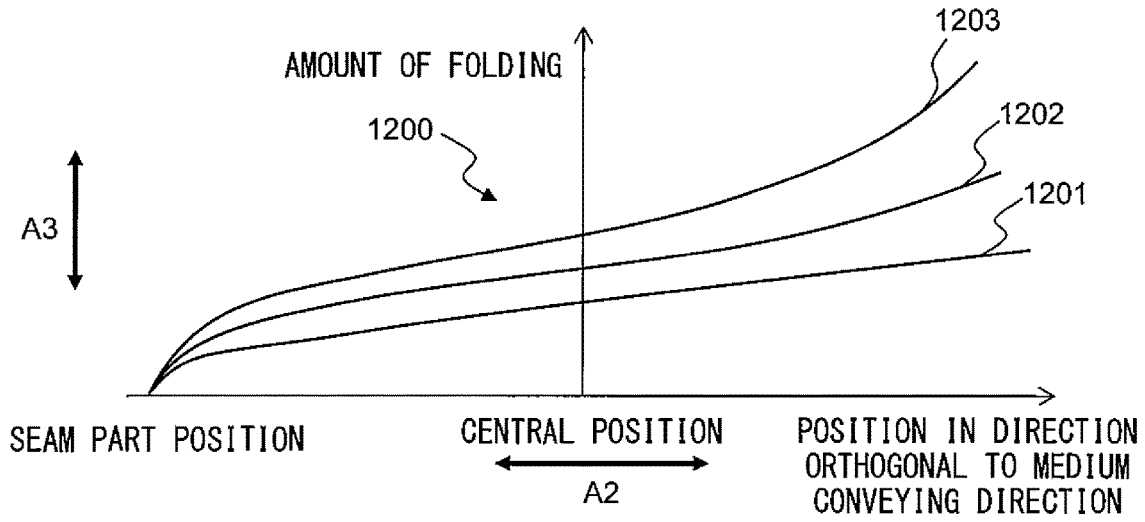
FIG. 12A is a schematic diagram for illustrating changes in an amount of folding of a medium over time.
Figure 12B:
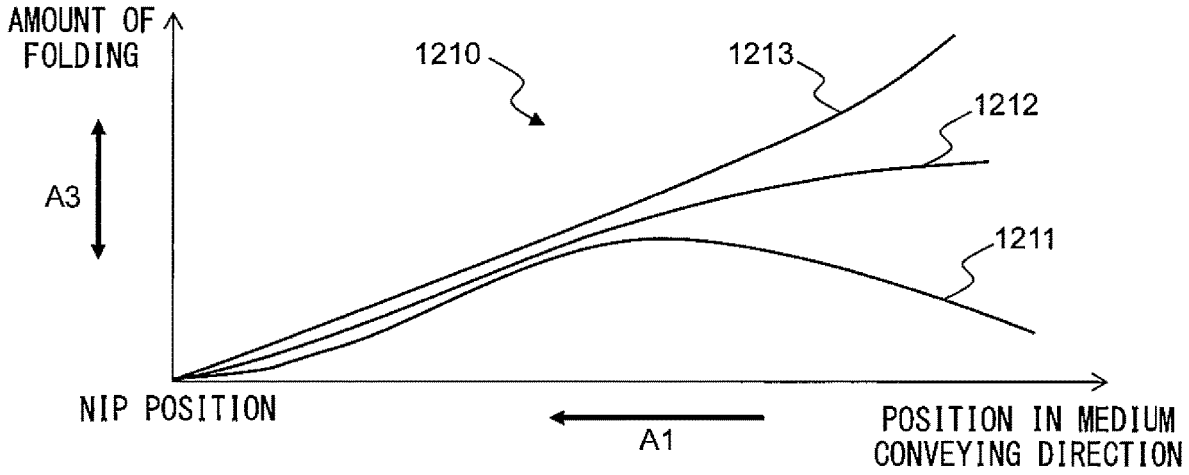
FIG. 12B is a schematic diagram for illustrating changes in an amount of folding of a medium over time.

FIG. 12A and FIG. 12B are schematic diagrams for illustrating changes in an amount of folding of a medium over time, the medium being fed in such a way that a seam part or a crease part is parallel with the medium conveying direction A1.

A graph 1200 in FIG. 12A illustrates an amount of folding of a medium viewed from the downstream side in the medium conveying direction A1 in the medium conveying apparatus 100. In FIG. 12A, the horizontal axis represents each position in the direction A2 perpendicular to the medium conveying direction, and the vertical axis represents an amount of folding of the medium at each position. The left end in FIG. 12A represents a position of the seam part or the crease part of the medium. A graph 1201 illustrates an amount of folding at a time T1, a graph 1202 illustrates an amount of folding at a time T2 after an elapse of a predetermined time from the time T1, and a graph 1203 illustrates an amount of folding at a time T3 after a further elapse of a predetermined time from the time T2.

A graph 1210 in FIG. 12B illustrates an amount of folding of the medium viewed from side in the medium conveying apparatus 100. In FIG. 12B, the horizontal axis represents each position in the medium conveying direction A1, and the vertical axis represents an amount of folding of the medium at each position. In FIG. 12B, the left side represents the downstream side, the right side represents the upstream side, and the left end represents the nip position of the feed rollers 116 and the brake rollers 117. A graph 1211 illustrates an amount of folding at the time T1, a graph 1212 illustrates an amount of folding at the time T2, and a graph 1213 illustrates an amount of folding at the time T3.

When a medium is fed in such a way that the seam part or the crease part is parallel with the medium conveying direction A1, an amount of folding at a position closer to an end facing the seam part or the crease part is larger, as illustrated in the graph 1201 in FIG. 12A. Further, in that case, an amount of folding at the end on the opposite side of the seam part or the crease part increases as time elapses, as illustrated in the graphs 1201 to 1203. Further, in that case, an amount of folding at a position closer to a central part in the medium conveying direction A1 is larger, as illustrated in the graph 1211 in FIG. 12B, and an amount of folding on the upstream side in the medium conveying direction A1 increases as time elapses, as illustrated in the graphs 1211 to 1213.

As described above, the second light emitters 111*a* and 112*a* are located outside in the direction A2 perpendicular to the medium conveying direction and emit the second light toward the upstream side of a medium placed on the medium tray 103 in the medium conveying direction A1. Accordingly, the folding detection module 152 can detect a folding of a medium fed in such a way that a seam part or a crease part is parallel with the medium conveying direction A1, in a short period and with high precision, based on second signals generated by the second optical sensors 111 and 112. Furthermore, by the second light emitters 111*a* and 112*a* being provided to emit the second light toward a central part of a medium placed on the medium tray 103 in the medium conveying direction A1, the folding detection module 152 can detect a folding of the medium in a shorter period.

Figure 13A:
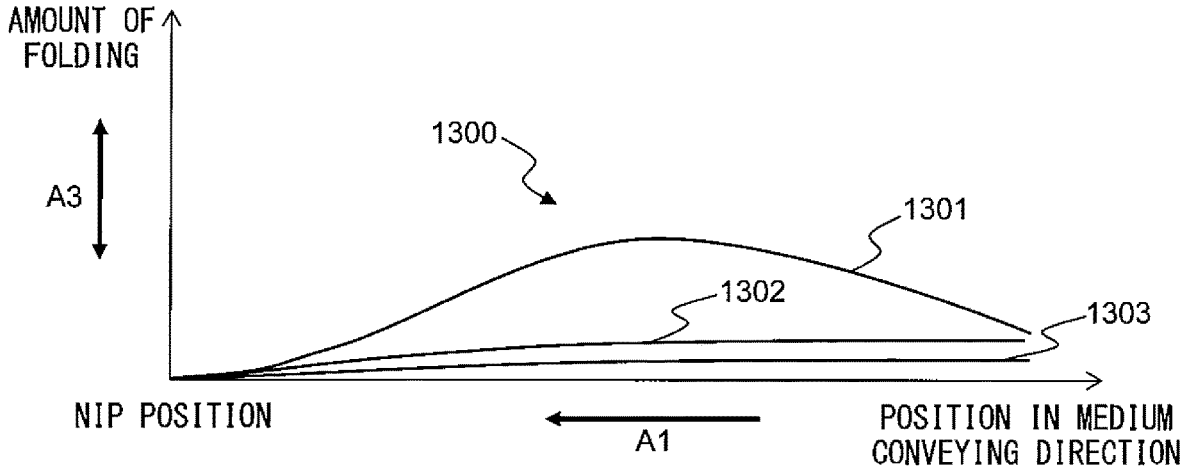
FIG. 13A is a schematic diagram for illustrating an amount of folding when a medium is loaded.
Figure 13B:
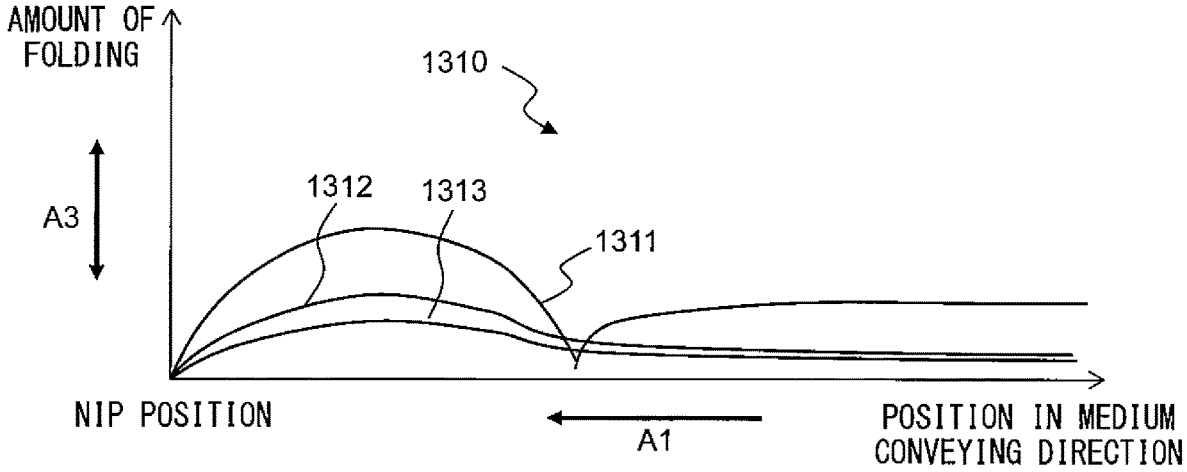
FIG. 13B is a schematic diagram for illustrating an amount of folding when a medium is loaded.

FIG. 13A and FIG. 13B are schematic diagrams for illustrating an amount of folding when another medium is loaded on a medium on which a folding is occurring. FIG. 13A is a schematic diagram for illustrating an amount of folding of a medium fed in such a way that a seam part or a crease part is parallel with the medium conveying direction A1, and FIG. 13B is a schematic diagram for illustrating an amount of folding of a medium fed in such a way that a seam part is perpendicular to the medium conveying direction A1.

Each of a graph 1300 in FIG. 13A and a graph 1310 in FIG. 13B illustrates an amount of folding of a medium viewed from the side of the medium conveying apparatus 100. In each of FIG. 13A and FIG. 13B, the horizontal axis represents each position in the medium conveying direction A1, and the vertical axis represents an amount of folding of a medium at each position. In each of FIG. 13A and FIG. 13B, the left side represents the downstream side, the right side represents the upstream side, and the left end represents the nip position of the feed rollers 116 and the brake rollers 117. Each of the graph 1301 and graph 1311 illustrates an amount of folding when another medium is not loaded on a bound medium. On the other hand, each of a graph 1302 and a graph 1312 illustrates an amount of folding when 10 sheets of PPC paper are loaded on the bound medium, and each of a graph 1303 and a graph 1313 illustrates an amount of folding when 50 sheets of PPC paper are loaded on the bound medium.

As illustrated in the graphs 1302 and 1303 in FIG. 13A, when another medium is placed on a medium fed in such a way that a seam part or a crease part is parallel with the medium conveying direction A1, the folding medium is pushed down by the other medium being placed, and an amount of folding decreases. However, even in that case, an amount of folding on the upstream side in the medium conveying direction A1 is sufficiently large. Accordingly, even when another medium is placed on a folding medium, the folding detection module 152 can detect the folding of the medium with high precision based on second signals generated by the second optical sensors 111 and 112.

Similarly, as illustrated in the graphs 1312 and 1313 in FIG. 13B, when another medium is placed on a medium fed in such a way that a seam part is perpendicular to the medium conveying direction A1, the folding medium is pushed down by the other medium being placed, and an amount of folding decreases. However, even in that case, an amount of folding on the downstream side in the medium conveying direction A1 is sufficiently large. Accordingly, even when another medium is placed on a folding medium, the folding detection module 152 can detect the folding of the medium with high precision based on a first signal generated by the first optical sensor 113.

Accordingly, in the so-called bottom-first type medium conveying apparatus 100 sequentially feeding media placed on the medium tray 103 from the lowermost side, the folding detection module 152 can detect a folding occurring on the lowest placed medium out of the loaded media, with high precision.

Figure 14A:
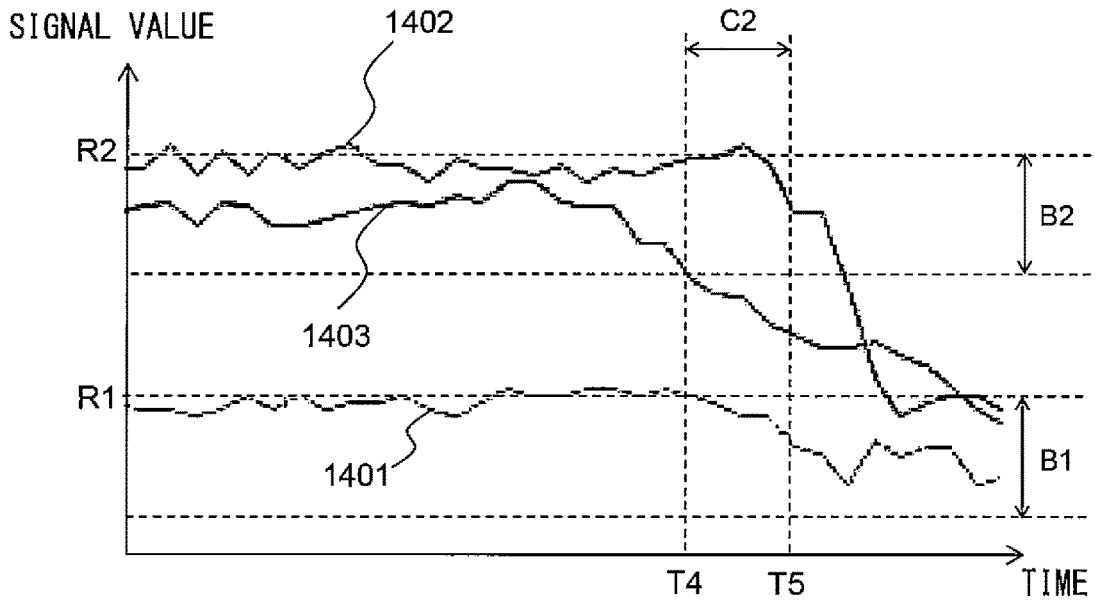
FIG. 14A is a schematic diagram for illustrating a signal value of each signal.

FIG. 14A is a schematic diagram for illustrating a signal value of each signal when a medium is fed in such a way that a seam part or a crease part is parallel with the medium conveying direction A1.

In FIG. 14A, the horizontal axis represents time, and the vertical axis represents a signal value. Graph 1401 illustrates a signal value of a first signal generated by the first optical sensor 113. A graph 1402 illustrates a signal value of a second signal generated by the second optical sensor 111 located on a seam part or crease part side, and a graph 1403 represents a signal value of a second signal generated by the second optical sensor 112 located on the opposite side of the seam part or the crease part.

As illustrated in FIG. 14A, when a medium is fed in such a way that a seam part or a crease part is parallel with the medium conveying direction A1, a variation in a signal value of the first signal with respect to a first reference value R1 is small and is less than B1. Accordingly, the folding detection module 152 cannot detect a folding of the medium based on the first signal. On the other hand, a variation of a signal value of each second signal with respect to a second reference value R2 is large and is greater than or equal to a second lower limit threshold value B2. Particularly, a signal value of the second signal generated by the second optical sensor 112 located on the opposite side of the seam part or the crease part changes in a short period. A variation of a signal value of the second signal becomes greater than or equal to the second lower limit threshold value B2 at a time T4 and is always greater than or equal to the second lower limit threshold value B2 until a time T5 at which a second period threshold value C2 elapses after the time T4. Accordingly, the folding detection module 152 can detect a folding of the medium based on the second signal generated by the second optical sensor 112 located on the opposite side of the seam part or the crease part.

Figure 14B:
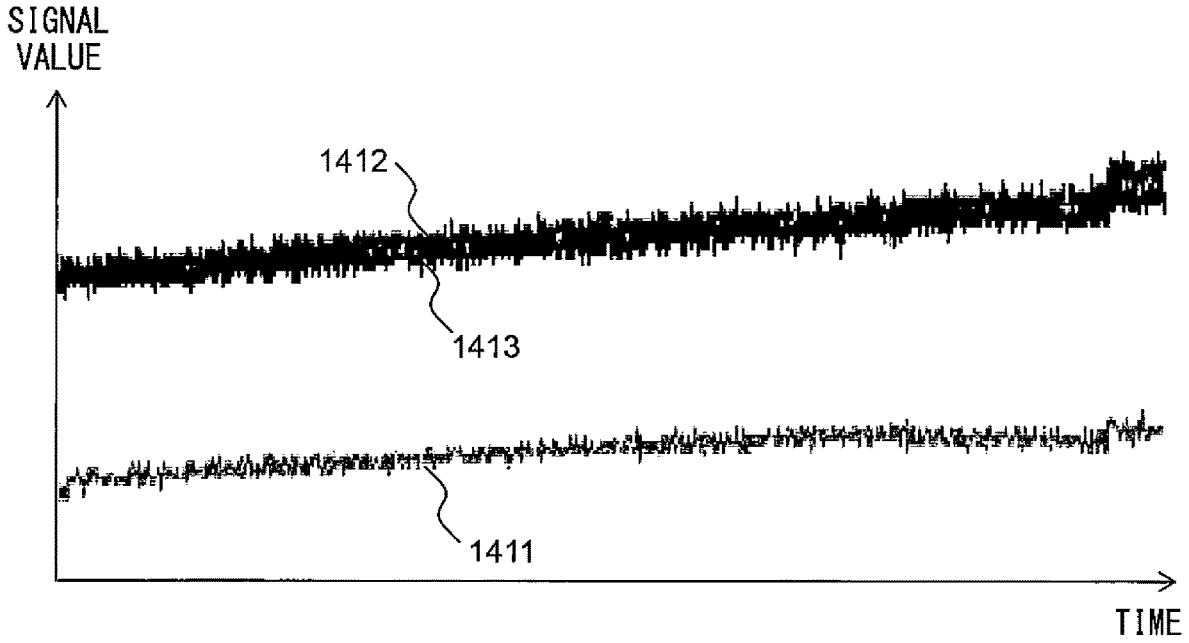
FIG. 14B is a schematic diagram for illustrating a signal value of each signal.

FIG. 14B is a schematic diagram for illustrating a signal value of each signal when a large number of unbound media are successively fed.

In FIG. 14B, the horizontal axis represents time, and the vertical axis represents a signal value. A graph 1411 illustrates a signal value of a first signal generated by the first optical sensor 113, and graphs 1412 and 1413 illustrate signal values of second signals generated by the second optical sensors 111 and 112. As illustrated in FIG. 14B, when a large number of unbound media are successively fed, every time a medium is fed one by one, an entire height of the media decreases. Accordingly, a distance between the highest position of the media and each of the first optical sensor 113 and the second optical sensors 111 and 112 gradually increases, and a signal value of each signal gradually increases. However, a variation of each signal for each fed medium is sufficiently small, and a folding of a medium is not mistakenly detected.

Figure 15A:
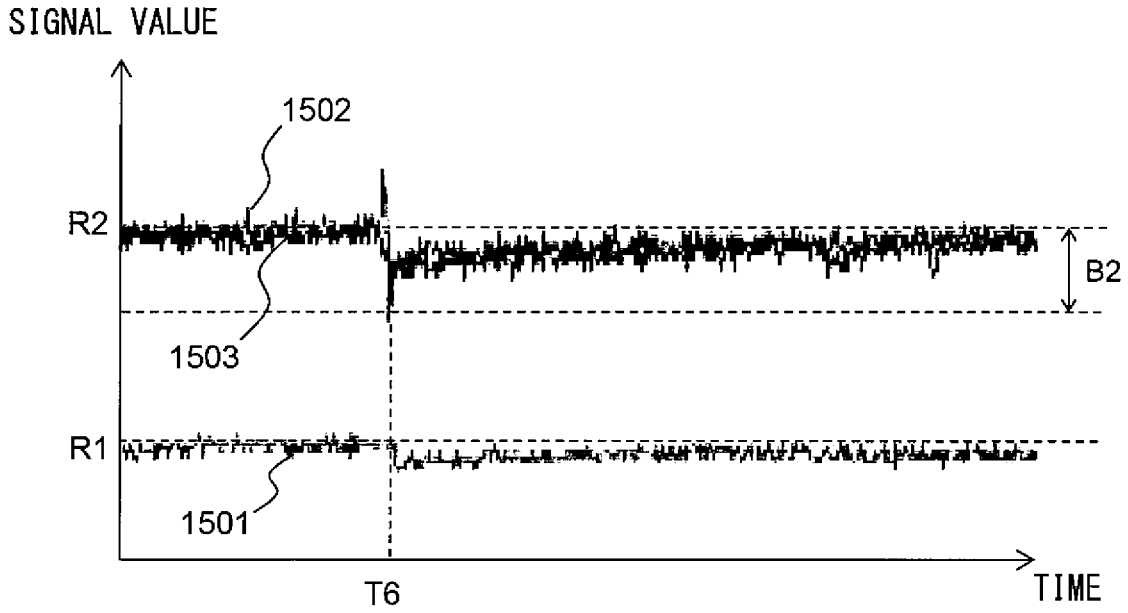
FIG. 15A is a schematic diagram for illustrating a signal value of each signal.

FIG. 15A is a schematic diagram for illustrating a signal value of each signal in a case of, while a large number of unbound media are successively fed, another medium is loaded (replenished) on the media by a user.

In FIG. 15A, the horizontal axis represents time, and the vertical axis represents a signal value. A graph 1501 illustrates a signal value of a first signal generated by the first optical sensor 113. On the other hand, graphs 1502 and 1503 illustrate signal values of second signals generated by the second optical sensors 111 and 112. In the example illustrated in FIG. 15A, a medium is replenished by the user at a time T6. At the time T6, a hand of the user enters between the medium, and the first optical sensor 113 and second optical sensors 111 and 112; and a signal value of each signal momentarily and considerably changes. However, the considerable change in a signal value is for a short period, and the hand of the user entering between the medium, and the first optical sensor 113 and the second optical sensors 111 and 112 is not mistakenly detected as a folding of a medium.

Figure 15B:
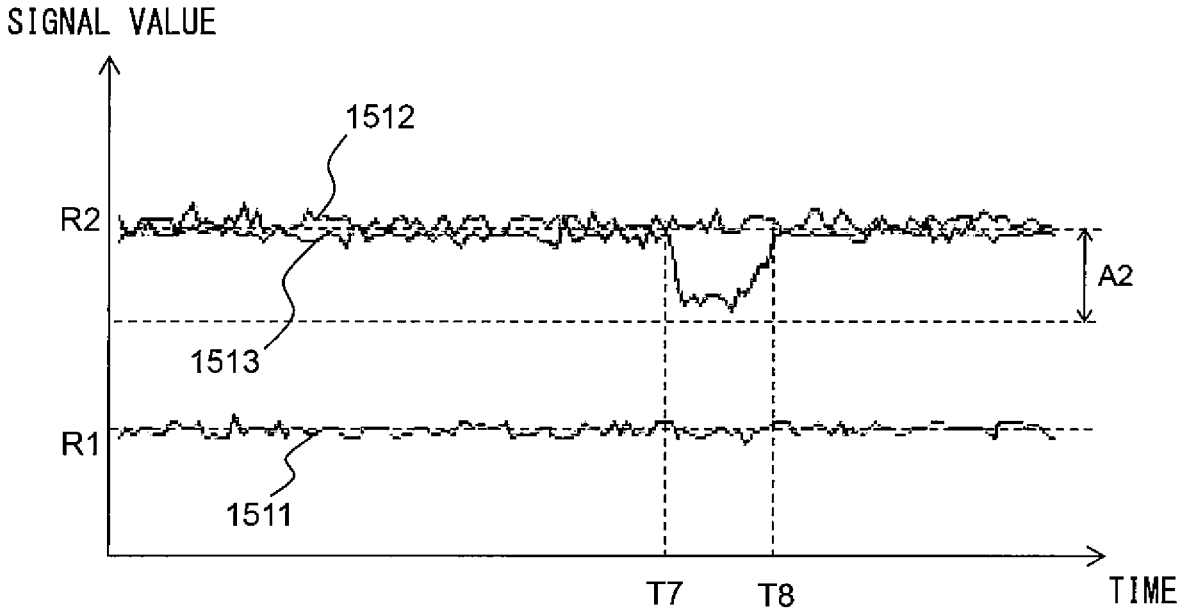
FIG. 15B is a schematic diagram for illustrating a signal value of each signal.

FIG. 15B is a schematic diagram for illustrating a signal value of each signal when a wrinkled medium is fed.

In FIG. 15B, the horizontal axis represents time, and the vertical axis represents a signal value. A graph 1511 illustrates a signal value of a first signal generated by the first optical sensor 113, and graphs 1512 and 1513 illustrate signal values of second signals generated by the second optical sensors 111 and 112, respectively. In the example illustrated in FIG. 15B, the second light is emitted to a wrinkle part of the medium by the second optical sensor 112 from a time T7 to a time T8. Consequently, a signal value of the second signal generated by the second optical sensor 112 changes from the time T7 to the time T8. However, a variation of a signal value is sufficiently less than a second lower limit threshold value and also a period in which the signal value changes is sufficiently less than a second period threshold value; and therefore the wrinkle formed on the medium is not mistakenly detected as a folding of the medium.

As described in detail above, while separating and feeding media, the medium conveying apparatus 100 detects a folding of a medium almost directly below by the first optical sensor 113 located in a central part and detects a folding of a medium at the rear end side by the second optical sensors 111 and 112 located outside. Then, the medium conveying apparatus 100 stops feeding of a medium depending on a detection result of a folding of the medium. Consequently, while separating and feeding media, the medium conveying apparatus 100 can detect a folding of a fed medium with high precision and when a medium not to be separated is fed, stop feeding of the medium with higher precision.

Figure 16:
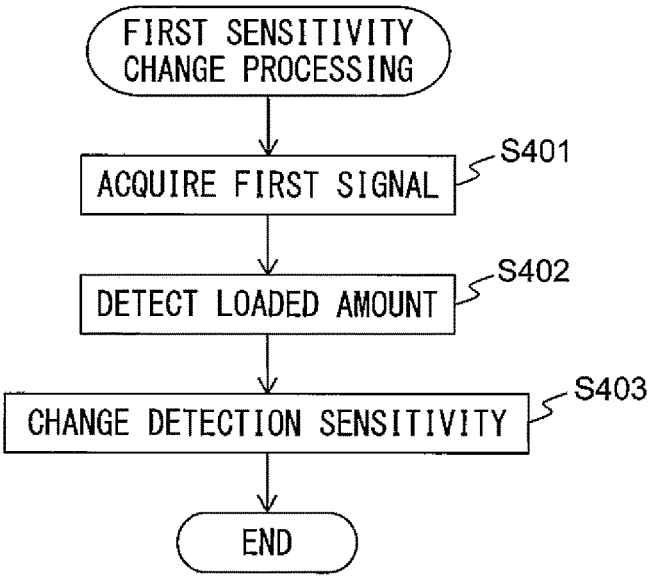
FIG. 16 is a flowchart illustrating an operation example of first sensitivity change processing.

FIG. 16 is a flowchart illustrating an operation example of first sensitivity change processing according to another embodiment.

An operation flow described below is executed mainly by the processing circuit 150 in cooperation with each element in the medium conveying apparatus 100, in accordance with a program previously stored in the storage device 140. The flowchart illustrated in FIG. 16 is periodically executed. Alternatively, the flowchart illustrated in FIG. 16 may be executed between the processing in step S202 and the processing in step S203 in FIG. 8.

First, the loaded amount detection module 154 acquires a first signal from the first optical sensor 113 (step S401).

Next, the loaded amount detection module 154 detects a loaded amount of media on the medium tray 103, that is, a height of the media placed on the medium tray 103 from the placement surface 103*a* (a height in the direction A3 perpendicular to the placement surface 103*a*) based on the acquired first signal (step S402). For example, the medium conveying apparatus 100 stores, in the storage device 140, a table associating each signal value of the first signal with a loaded amount of media based on a relation between a signal value of the first signal and a loaded amount of media, the relation being acquired in a previously performed experiment. The folding detection module 152 refers to the stored table and specifies a loaded amount of media related to a signal value of the acquired first signal.

Next, the folding detection module 152 changes a detection sensitivity for detecting a folding of a medium based on the calculated loaded amount (step S403) and ends the series of steps. As a loaded amount increases, a fed medium is more firmly pressed by media loaded on the medium, and therefore an amount of folding of the medium decreases. Accordingly, as a loaded amount increases, the folding detection module 152 increases the detection sensitivity in order to facilitate detection of a folding of a medium. For example, the folding detection module 152 increases the detection sensitivity by changing the first lower limit threshold value and the second lower limit threshold value in such a way as to decrease each threshold value as a loaded amount increases. Further, the folding detection module 152 may increase the detection sensitivity by changing the first period threshold value and the second period threshold value in such a way as to decrease each threshold value as a loaded amount increases. Consequently, even when a large number of media are loaded on the medium tray 103, the folding detection module 152 can detect a folding of a medium with high precision.

Figure 17:
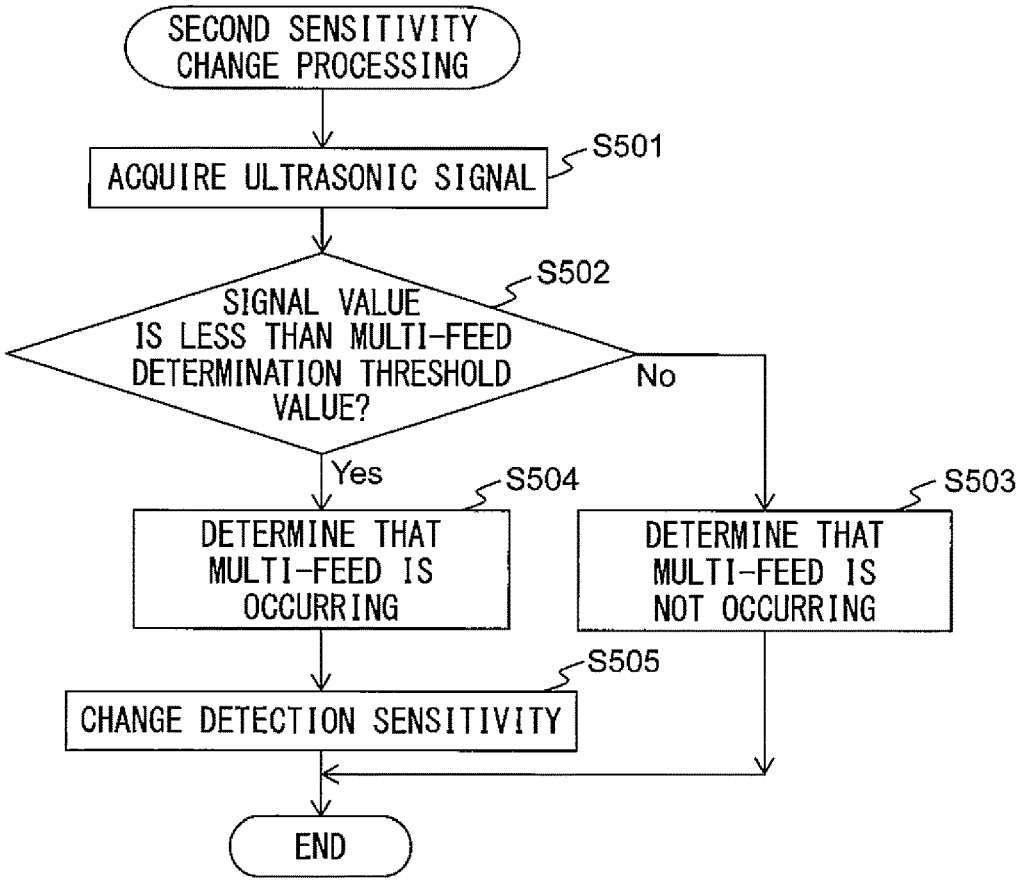
FIG. 17 is a flowchart illustrating an operation example of second sensitivity change processing.

FIG. 17 is a flowchart illustrating an operation example of second sensitivity change processing according to another embodiment.

The operation flow described below is executed mainly by the processing circuit 150 in cooperation with each element in the medium conveying apparatus 100, in accordance with a program previously stored in the storage device 140. The operation flow illustrated in FIG. 16 is periodically executed. When the flowchart illustrated in FIG. 17 is executed, the processing in steps S201 and S202 in FIG. 8 is omitted. Alternatively, in this case, whether or not a medium exists at the position of the fifth medium detection sensor 122 is determined based on a fifth medium detection signal from the fifth medium detection sensor 122 in step S202. The second sensitivity change processing is executed in place of the first sensitivity change processing or in addition to the first sensitivity change processing.

First, the multi-feed detection module 155 acquires an ultrasonic signal from the ultrasonic sensor 119 (step S501).

Next, the multi-feed detection module 155 determines whether or not a signal value of the acquired ultrasonic signal is less than a multi-feed determination threshold value (step S502).

Figure 18:
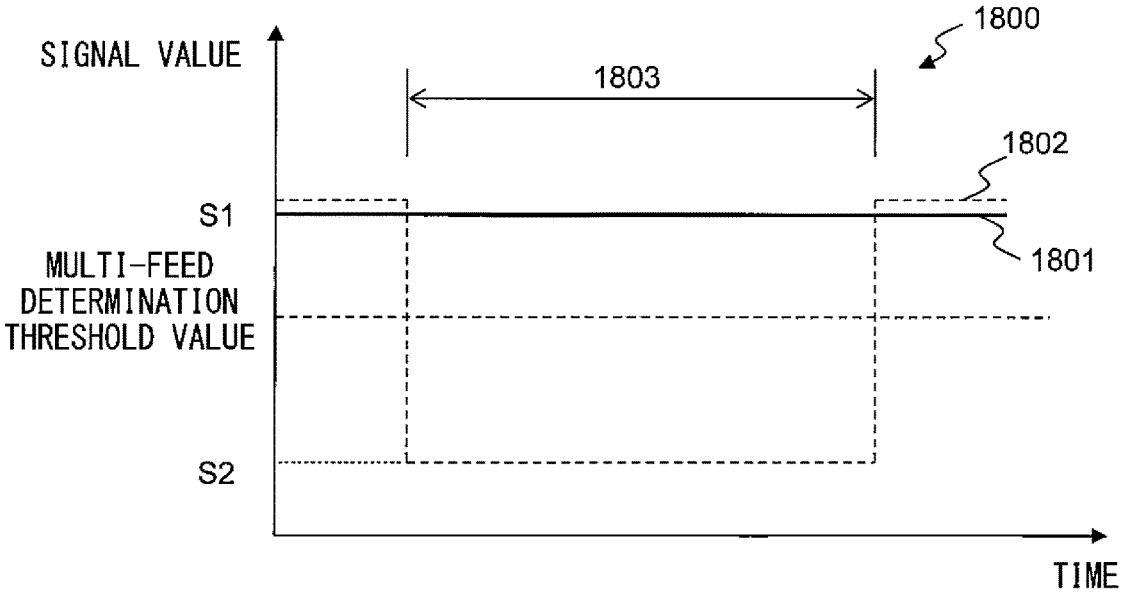
FIG. 18 is a schematic diagram for illustrating a characteristic of an ultrasonic signal.

FIG. 18 is a schematic diagram for illustrating a characteristic of an ultrasonic signal.

In a graph 1800 in FIG. 18, a solid line 1801 represents a characteristic of an ultrasonic signal when one sheet of paper is conveyed as a medium, and a dotted line 1802 represents a characteristic of an ultrasonic signal when multi-feed of paper is occurring. The horizontal axis of the graph 1800 indicates time, and the vertical axis indicates a signal value of an ultrasonic signal. Due to occurrence of multi-feed, a signal value of the ultrasonic signal in the dotted line 1802 declines in a section 1803. The multi-feed determination threshold value is set to a value between a signal value S1 of an ultrasonic signal when one sheet of paper is conveyed and a signal value S2 of an ultrasonic signal when multi-feed of paper is occurring. By determining whether or not a signal value of an ultrasonic signal is less than the multi-feed determination threshold value, the multi-feed detection module 155 can determine whether or not multi-feed of a medium is occurring.

When a signal value of the ultrasonic signal is greater than or equal to the multi-feed determination threshold value, the multi-feed detection module 155 determines that multi-feed is not occurring (step S503) and ends the series of steps.

On the other hand, when a signal value of the ultrasonic signal is less than the multi-feed determination threshold value, the multi-feed detection module 155 determines that multi-feed is occurring (step S504). Thus, the multi-feed detection module 155 detects multi-feed of a medium based on an ultrasonic signal generated by the ultrasonic sensor 119.

Next, the folding detection module 152 changes a detection sensitivity to detect a folding of a medium based on the detection result of multi-feed of the medium (step S505) and ends the series of steps.

When multi-feed of media is occurring, it is highly likely that a medium folded in two or a bound medium is fed. Accordingly, the folding detection module 152 facilitates detection of a folding of a medium by setting a detection sensitivity in a case of multi-feed of media being detected higher than a detection sensitivity in a case of multi-feed of media not being detected. For example, the folding detection module 152 increases the detection sensitivity by changing the first lower limit threshold value and the second lower limit threshold value in such a way that each threshold value in a case of multi-feed of media being detected is less than each threshold value in a case of multi-feed of media not being detected, respectively. Further, the folding detection module 152 may increase the detection sensitivity by changing the first period threshold value and the second period threshold value in such a way that each threshold value in a case of multi-feed of media being detected is less than each threshold value in a case of multi-feed of media not being detected, respectively. Consequently, the folding detection module 152 can detect a folding of a medium with higher precision.

Figure 19:
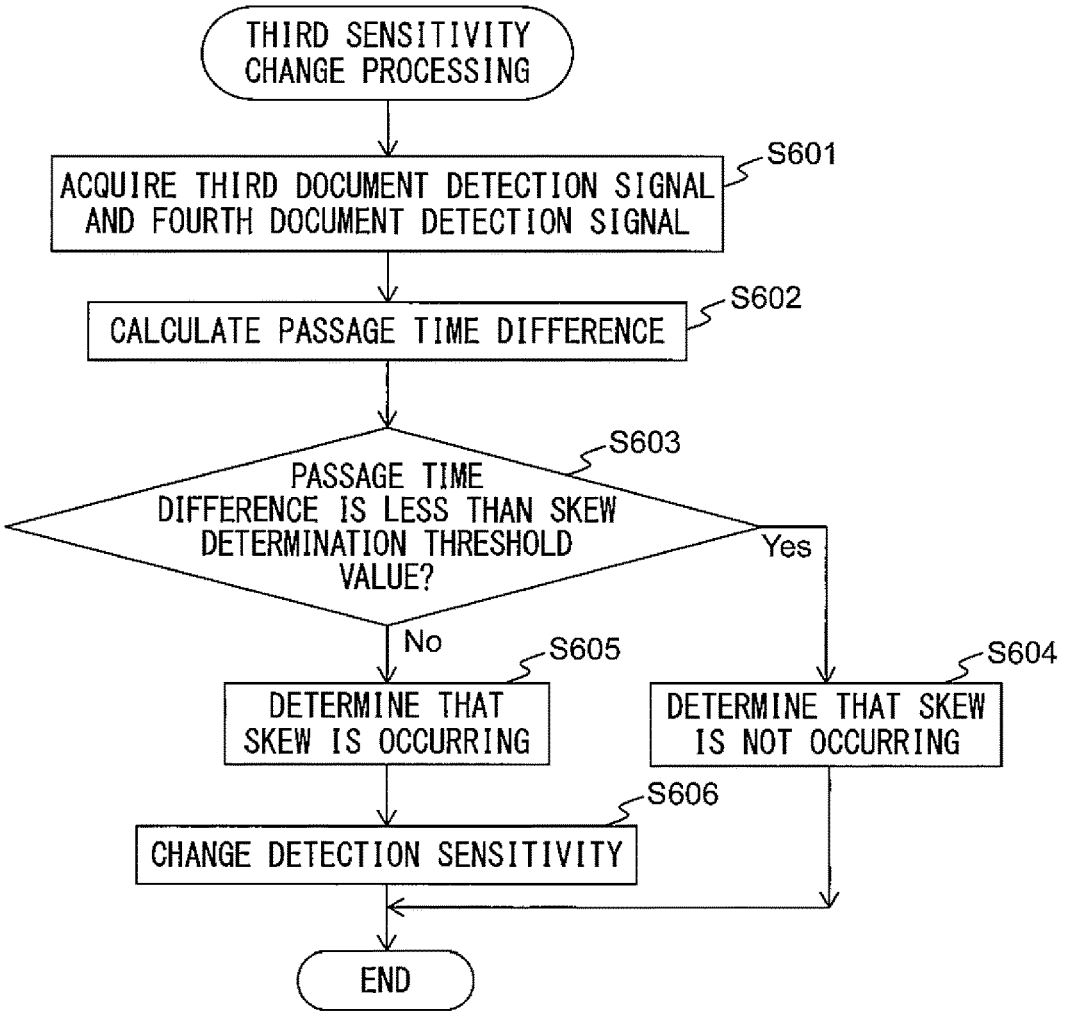
FIG. 19 is a flowchart illustrating an operation example of third sensitivity change processing.

FIG. 19 is a flowchart illustrating an operation example of third sensitivity change processing according to another embodiment.

The operation flow described below is executed mainly by the processing circuit 150 in cooperation with each element in the medium conveying apparatus 100, in accordance with a program previously stored in the storage device 140. The operation flow illustrated in FIG. 19 is periodically executed. When the flowchart illustrated in FIG. 19 is executed, the processing in steps S201 and S202 in FIG. 8 is omitted. Alternatively, in this case, whether or not a medium exists at the position of the fifth medium detection sensor 122 is determined based on a fifth medium detection signal from the fifth medium detection sensor 122 in step S202. The third sensitivity change processing is executed in place of the first sensitivity change processing or the second sensitivity change processing, or in addition to the first sensitivity change processing and the second sensitivity change processing.

First, the skew detection module 156 acquires a third medium detection signal from the third medium detection sensor 120 and acquires a fourth medium detection signal from the fourth medium detection sensor 121 (step S601).

Next, the skew detection module 156 calculates a passage time difference between a time when the front edge of a medium passes the third medium detection sensor 120 and a time when the front edge passes the fourth medium detection sensor 121, based on the acquired third medium detection signal and fourth medium detection signal (step S602).

The skew detection module 156 detects a time when a signal value of the third medium detection signal out of signal values of the third medium detection signal acquired up to the present time changes from a value indicating a state in which a medium does not exist to a value indicating a state in which a medium exists, as a time when the front edge of the medium passes the third medium detection sensor 120. Similarly, the skew detection module 156 detects a time when a signal value of the fourth medium detection signal out of signal values of the fourth medium detection signal acquired up to the present time changes from a value indicating a state in which a medium does not exist to a value indicating a state in which a medium exists, as a time when the front edge of the medium passes the fourth medium detection sensor 121. The skew detection module 156 calculates, as a passage time difference, a time period from a time when the front edge of the medium passes either of the third medium detection sensor 120 or the fourth medium detection sensor 121 to a time when the front edge passes the other sensor. When the front edge of the medium has not yet passed one sensor, the skew detection module 156 calculates a time period from a time when the front edge of the medium passes the other sensor to the present time, as a passage time difference.

Next, the skew detection module 156 determines whether or not the calculated passage time difference is less than a skew determination threshold value (step S603).

When the calculated passage time difference is less than the skew determination threshold value, the skew detection module 156 determines that a skew being an oblique movement of a medium is not occurring (step S604) and ends the series of steps.

On the other hand, when the calculated passage time difference is greater than or equal to the skew determination threshold value, the skew detection module 156 determines that a skew is occurring (step S605). Thus, the skew detection module 156 detects a skew of a medium based on a third medium detection signal generated by the third medium detection sensor 120 and a fourth medium detection signal generated by the fourth medium detection sensor 121.

Next, the folding detection module 152 changes the detection sensitivity to detect a folding of a medium based on the detection result of a skew of the medium (step S606) and ends the series of steps.

In a case of a medium folded in two or a bound medium being fed, it is highly likely that a skew of the medium occurs when the front edge of the medium passes the nip position of the feed rollers 116 and the brake rollers 117. Accordingly, the folding detection module 152 facilitates detection of a folding of a medium by setting a detection sensitivity in a case of a skew of a medium being detected higher than a detection sensitivity in a case of a skew of a medium not being detected. For example, the folding detection module 152 increases the detection sensitivity by changing the first lower limit threshold value and the second lower limit threshold value in such a way that each threshold value in a case of a skew of a medium being detected is less than each threshold value in a case of a skew of a medium not being detected, respectively. Further, the folding detection module 152 may increase the detection sensitivity by changing the first period threshold value and the second period threshold value in such a way that each threshold value in a case of a skew of a medium being detected is less than each threshold value in a case of a skew of a medium not being detected, respectively. Consequently, the folding detection module 152 can detect a folding of a medium with higher precision.

The detection sensitivity may be changed by a user. In that case, the folding detection module 152 accepts setting of the detection sensitivity (the first lower limit threshold value, the second lower limit threshold value, the first period threshold value and/or the second period threshold value) using the operation device 105 by the user. The user may increase the detection sensitivity when a soft medium being less likely to bend, such as thin paper, is conveyed and decrease the detection sensitivity when a medium being more likely to be mistakenly determined to be folding, such as wrinkled paper, is conveyed. Consequently, the folding detection module 152 can detect a folding of a medium with higher precision.

As described in detail above, by operating in accordance with the flowcharts illustrated in FIG. 16, FIG. 17 and/or FIG. 19, the medium conveying apparatus 100 can detect a folding of a medium with higher precision.

Figure 20:
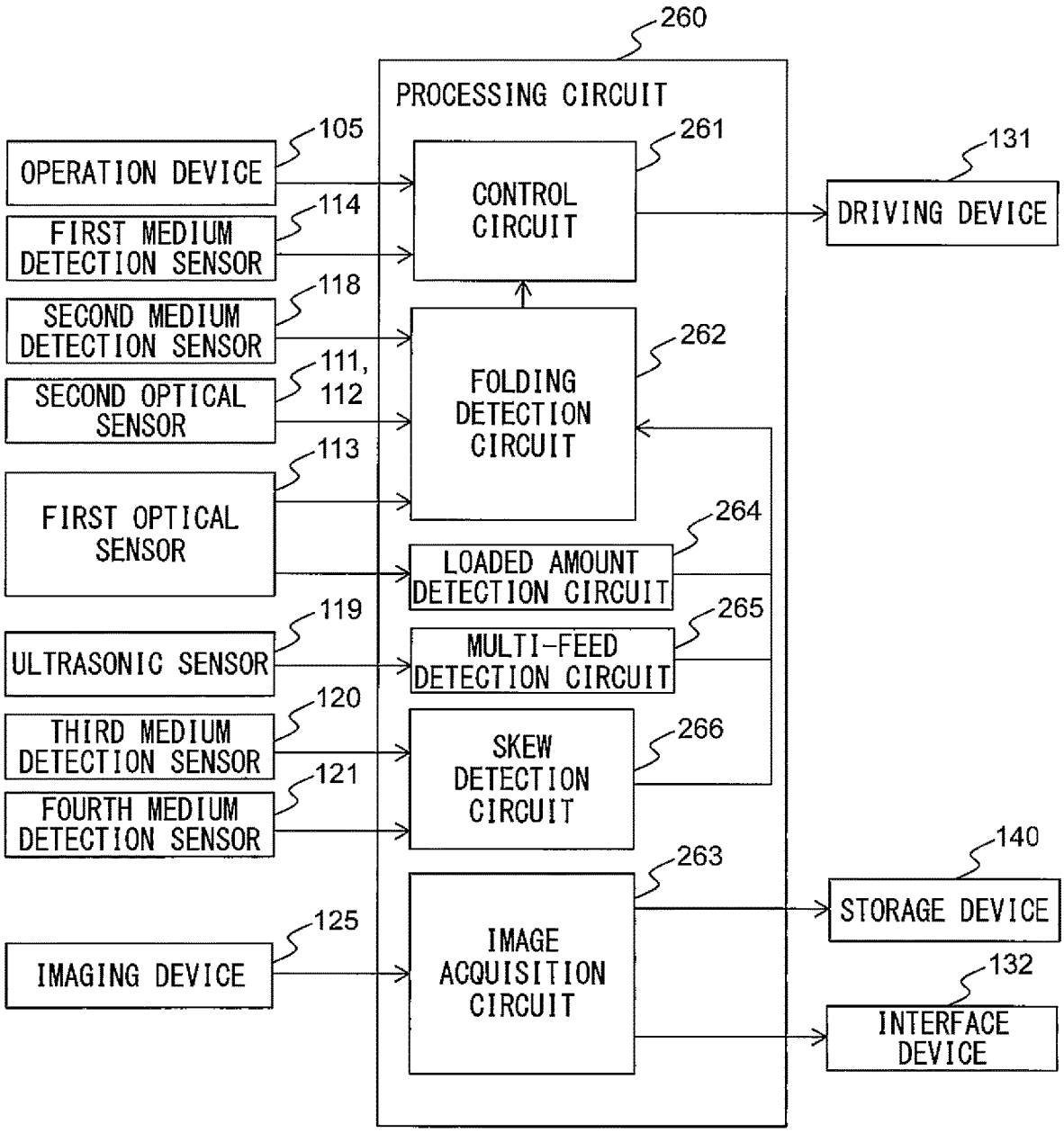
FIG. 20 is a diagram illustrating a schematic configuration of a processing circuit 260 in another medium conveying apparatus.

FIG. 20 is a diagram illustrating a schematic configuration of a processing circuit 260 in a medium conveying apparatus according to yet another embodiment. The processing circuit 260 is used in place of the processing circuit 150 in the medium conveying apparatus 100 and executes the medium reading processing, the folding detection processing, the first sensitivity change processing, the second sensitivity change processing and the third sensitivity change processing in place of the processing circuit 150. The processing circuit 260 includes a control circuit 261, a folding detection circuit 262, an image acquisition circuit 263, a loaded amount detection circuit 264, a multi-feed detection circuit 265, and the skew detection circuit 266, etc.

The control circuit 261 is an example of a control module and has a function similar to the control module 151. The control circuit 261 receives an operation signal from an operation device 105, a first medium detection signal from a first medium detection sensor 114, and a detection result of a folding of a medium from the folding detection circuit 262. The control circuit 261 drives a driving device 131 based on each of the received signals and also when a folding of a medium is detected, stops feeding of the medium.

The folding detection circuit 262 is an example of a folding detection module and has a function similar to the folding detection module 152. The folding detection circuit 262 receives a first signal from a first optical sensor 113, second signals from second optical sensors 111 and 112, and a second medium detection signal from a second medium detection sensor 118. Further, the folding detection circuit 262 receives a detection result of a loaded amount of media from the loaded amount detection circuit 264, a detection result of multi-feed of media from the multi-feed detection circuit 265, and a detection result of a skew of a medium from the skew detection circuit 266. The folding detection circuit 262 detects a folding of a medium based on each piece of received information and outputs the detection result to the control circuit 261.

The image acquisition circuit 263 is an example of an image acquisition module and has a function similar to the image acquisition module 153. The image acquisition circuit 263 receives an input image from an imaging device 125 and stores the input image into a storage device 140, and also transmits the input image to an unillustrated information processing device through an interface device 132.

The loaded amount detection circuit 264 is an example of a loaded amount detection module and has a function similar to the loaded amount detection module 154. The loaded amount detection circuit 264 receives a first signal from the first optical sensor 113, detects a loaded amount of media based on the first signal, and outputs the detection result to the folding detection circuit 262.

The multi-feed detection circuit 265 is an example of a multi-feed detection module and has a function similar to the multi-feed detection module 155. The multi-feed detection circuit 265 receives an ultrasonic signal from an ultrasonic sensor 119, detects multi-feed of media based on the ultrasonic signal, and outputs the detection result to the folding detection circuit 262.

The skew detection circuit 266 is an example of a skew detection module and has a function similar to the skew detection module 153. The skew detection circuit 266 receives a third medium detection signal from a third medium detection sensor 115, a fourth medium detection signal 1 from a fourth medium detection sensor 121. The skew detection circuit 274 detects a skew of a medium based on each received signal and outputs the detection result to the folding detection circuit 262.

As described in detail above, even when using the processing circuit 260, the medium conveying apparatus, can stop feeding of the medium with higher precision when a medium not to be separated is fed.

Each part included in the processing circuit may be independently configured with an integrated circuit, a microprocessor, firmware, etc. Further, some parts included in the processing circuit may be configured with a circuit, and other parts may be configured with a functional module implemented by software operating on a processor.

According to this embodiment, the medium conveying apparatus, the method, and the computer-readable, non-transitory medium storing the control program, according to the present invention, can, while separating and feeding media, stop feeding of media with higher precision when a medium not to be separated is fed.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium conveying apparatus comprising:

a housing;

a medium tray;

a feed roller to feed a medium on the medium tray;

a first optical sensor located on an upper part of the housing and in a central part of the housing in a direction perpendicular to a medium conveying direction, and including a first light emitter for emitting first light and a first light receiver for generating a first signal based on receiving the first light;

a second optical sensor located on an upper part of the housing and on a side of the first optical sensor in the direction perpendicular to the medium conveying direction, and including a second light emitter for emitting second light and a second light receiver for generating a second signal based on receiving the second light; and a processor to detect a folding of the medium based on at least the first signal or the second signal, and stop feeding of the medium by the feed roller in accordance with a detection result of the folding of the medium, wherein the first light emitter emits the first light toward a downstream side of a predetermined position on the housing or the medium tray in the medium conveying direction, and wherein the second light emitter emits the second light toward an upstream side of the predetermined position in the medium conveying direction.

2. The medium conveying apparatus according to claim 1, wherein the second optical sensor is located on an upstream side of the first optical sensor in the medium conveying direction.

3. The medium conveying apparatus according to claim 1, further comprising a pressing member to press the medium placed on the medium tray, wherein the first optical sensor and the second optical sensor are located on an upstream side of the pressing member in the medium conveying direction.

4. The medium conveying apparatus according to claim 1, wherein the feed roller sequentially feeds the medium placed on the medium tray from a lowermost side.

5. The medium conveying apparatus according to claim 1, wherein, when stopping feeding of the medium, the processor controls the feed roller in such a way that the medium is temporarily reset to the medium tray and is refed without being separated.

6. The medium conveying apparatus according to claim 1, further comprising a medium detection sensor located on a downstream side of the feed roller in the medium conveying direction, wherein, when the medium exists at a position of the medium detection sensor, the processor does not detect the folding of the medium.

7. The medium conveying apparatus according to claim 1, wherein the processor detects the folding of the medium by comparing a signal value of the first signal at a predetermined timing with a signal value of the first signal or a signal value of the second signal at another timing.

8. The medium conveying apparatus according to claim 1, wherein the processor detects a loaded amount of the medium on the medium tray based on the first signal, and the processor changes a sensitivity to detect the folding of the medium based on the loaded amount.

9. The medium conveying apparatus according to claim 1, wherein the processor detects multi-feed of the medium, and the processor changes a sensitivity to detect the folding of the medium based on a detection result of multi-feed of the medium.

10. The medium conveying apparatus according to claim 1, wherein the processor detects a skew of the medium, and the processor changes a sensitivity to detect the folding of the medium based on a detection result of a skew of the medium.

11. The medium conveying apparatus according to claim 1, wherein the processor does not detect the folding of the medium when a variation of a signal value of the first signal or the second signal is greater than a threshold value.

12. The medium conveying apparatus according to claim 1, further comprising a side guide, provided on the medium tray in such a way as to be movable in the direction perpendicular to the medium conveying direction, for regulating a width direction of the medium, wherein a height of the side guide is greater than a maximum loading capacity of the medium on the medium tray, and the processor does not detect the folding of the medium based on the second signal, when a height of the medium detected based on the second signal is greater than the maximum loading capacity.

13. A method for detecting a folding of a medium, the method comprising:

feeding the medium on a medium tray by a feed roller;

emitting first light by a first light emitter of a first optical sensor located on an upper part of a housing and in a central part of the housing in a direction perpendicular to a medium conveying direction;

generating a first signal based on receiving the first light by a first light receiver of the first optical sensor;

emitting second light by a second light emitter of a second optical sensor located on an upper part of the housing and on a side of the first optical sensor on the housing in the direction perpendicular to the medium conveying direction;

generating a second signal based on receiving the second light by a second light receiver of the second optical sensor;

detecting the folding of the medium based on at least the first signal or the second signal; and stopping feeding of the medium by the feed roller in accordance with a detection result of the folding of the medium, wherein the first light emitter emits the first light toward a downstream side of a predetermined position on the housing or the medium tray in the medium conveying direction, and the second light emitter emits the second light toward an upstream side of the predetermined position in the medium conveying direction.

14. The method according to claim 13, wherein the second optical sensor is located on an upstream side of the first optical sensor in the medium conveying direction.

15. The method according to claim 13, further comprising pressing the medium placed on the medium tray by a pressing member, wherein the first optical sensor and the second optical sensor are located on an upstream side of the pressing member in the medium conveying direction.

16. The method according to claim 13, wherein the medium placed on the medium tray is fed from a lowermost side by the feed roller, in the feeding step.

17. The method according to claim 13, wherein, when stopping feeding of the medium, the feed roller is controlled in such a way that the medium is temporarily reset to the medium tray and is refed without being separated, in the stopping step.

18. The method according to claim 13, wherein, when the medium exists at a position of a medium detection sensor located on a downstream side of the feed roller in the medium conveying direction, the folding of the medium is not detected, in the detecting step.

19. The method according to claim 13, wherein the folding of the medium is detected by comparing a signal value of the first signal at a predetermined timing with a signal value of the first signal or a signal value of the second signal at another timing, in the detecting step.

20. A computer-readable, non-transitory medium storing a computer program, the computer program when executed by one or more processor performs a method for detecting a folding of a medium, the method comprising:

feeding the medium on a medium tray by a feed roller;

emitting first light by a first light emitter of a first optical sensor located on an upper part of a housing and in a central part of the housing in a direction perpendicular to a medium conveying direction;

generating a first signal based on receiving the first light by a first light receiver of the first optical sensor;

emitting second light by a second light emitter of a second optical sensor located on an upper part of the housing and on a side of the first optical sensor on the housing in the direction perpendicular to the medium conveying direction;

generating a second signal based on receiving the second light by a second light receiver of the second optical sensor;

detecting the folding of the medium based on at least the first signal or the second signal; and stopping feeding of the medium by the feed roller in accordance with a detection result of the folding of the medium, wherein the first light emitter emits the first light toward a downstream side of a predetermined position on the housing or the medium tray in the medium conveying direction, and the second light emitter emits the second light toward an upstream side of the predetermined position in the medium conveying direction.

* * * * *